US008051586B2

(12) United States Patent
Auger et al.

(10) Patent No.: US 8,051,586 B2
(45) Date of Patent: Nov. 8, 2011

(54) CUSTOMIZATION SYSTEM FOR AN ARTICLE OF FOOTWEAR

(75) Inventors: Perry Auger, Tigard, OR (US); Kendall Shapiro, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 1143 days.

(21) Appl. No.: 11/456,174

(22) Filed: Jul. 7, 2006

(65) Prior Publication Data

US 2008/0005933 A1 Jan. 10, 2008

(51) Int. Cl.

| | |
|---|---|
| ***A43B 7/16*** | (2006.01) |
| ***A43B 23/22*** | (2006.01) |
| ***A43B 13/18*** | (2006.01) |
| ***A43B 3/24*** | (2006.01) |
| ***A43B 13/00*** | (2006.01) |

(52) U.S. Cl. ..... 36/92; 36/100; 36/103; 36/30 R; 36/76 C

(58) Field of Classification Search ..... 36/43, 44, 36/88, 89, 92, 100, 72 B, 71, 35 R, 36 B, 36/73, 69, 93, 105, 76 HH, 80, 68, 58.5, 58.6, 36/30 R, 76 C, 103, 76 R, 107, 108
See application file for complete search history.

(56) References Cited

U.S. PATENT DOCUMENTS

| | | | | |
|---|---|---|---|---|
| 4,398,715 | A * | 8/1983 | Hall | 473/501 |
| 4,651,445 | A * | 3/1987 | Hannibal | 36/103 |
| 4,694,590 | A * | 9/1987 | Greenawalt | 36/91 |
| 4,697,362 | A * | 10/1987 | Wasserman | 36/136 |
| 4,757,620 | A * | 7/1988 | Tiitola | 36/28 |
| RE33,648 | E * | 7/1991 | Brown | 36/44 |
| 5,090,140 | A * | 2/1992 | Sessa | 36/138 |
| 5,400,529 | A * | 3/1995 | Bell et al. | 36/93 |
| 5,617,653 | A * | 4/1997 | Walker et al. | 36/134 |
| 5,733,647 | A * | 3/1998 | Moore et al. | 428/304.4 |
| 6,036,607 | A * | 3/2000 | Finegan | 473/206 |
| 6,145,221 | A * | 11/2000 | Hockerson | 36/126 |
| 6,311,415 | B1 * | 11/2001 | Lind | 36/130 |
| 6,442,874 | B1 * | 9/2002 | Long | 36/97 |
| 6,474,003 | B2 | 11/2002 | Erickson et al. | |
| 6,536,137 | B1 * | 3/2003 | Celia | 36/28 |

(Continued)

FOREIGN PATENT DOCUMENTS

GB 2242344 A * 10/1991

OTHER PUBLICATIONS

International Preliminary Report on Patentability, mailed Jan. 22, 2009, from PCT Application No. PCT/US2007/072628.

*Primary Examiner* — Jila Mohandesi
*Assistant Examiner* — Melissa Lalli
(74) *Attorney, Agent, or Firm* — Plumsea Law Group, LLC

(57) ABSTRACT

A customization system for an article of footwear is disclosed. The customization system comprises an insert system. The insert system includes an insert and a heel member. Both the insert and the heel member may be interchangeable, allowing the user to modify the article of footwear to provide a customized fit or performance optimization. An article of footwear may also include a full length composite plate to be used as part of an outsole assembly. The full length composite plate may comprise a composite material that has a certain percent elongation, and can include a heel cup for heel stability and improved traction.

21 Claims, 17 Drawing Sheets

U.S. PATENT DOCUMENTS 6,584,707 B1 * 7/2003 Racine et al. ..... 36/97
6,910,287 B2 * 6/2005 Truelsen ..... 36/30 R
7,168,188 B2 * 1/2007 Auger et al. ..... 36/69
7,293,370 B2 * 11/2007 Kaplan et al. ..... 36/8.4
7,401,421 B2 * 7/2008 Brennan ..... 36/30 R
7,832,117 B2 * 11/2010 Auger et al. ..... 36/30 R
2002/0007568 A1 * 1/2002 Kellerman et al. ..... 36/28
2004/0107601 A1 * 6/2004 Schmid ..... 36/28
2006/0010718 A1 1/2006 Auger et al.
2006/0021257 A1 * 2/2006 Hung ..... 36/73

* cited by examiner

CUSTOMIZATION SYSTEM FOR AN ARTICLE OF FOOTWEAR

BACKGROUND OF THE INVENTION

1. Field of the Invention

The present invention relates generally to footwear, and in particular the present invention relates to a customization system for footwear and to a composite plate in footwear outsoles.

2. Description of Related Art

Conventional articles of footwear include two primary elements: an upper and a sole structure. The upper is often formed of leather, synthetic materials, or a combination thereof and comfortably secures the footwear to the wearer's foot while also providing ventilation and protection from the elements. The sole structure generally incorporates multiple layers that are conventionally referred to as an insole, a midsole, and an outsole. The insole is a thin cushioning member located within the upper and adjacent the sole of the foot to enhance footwear comfort. The midsole, which is traditionally attached to the upper along the entire length of the upper, forms the middle layer of the sole structure and serves a variety of purposes that include controlling potentially harmful foot motions, such as over-pronation, attenuating ground reaction forces, and absorbing energy. The outsole forms the ground-contacting element of the footwear, and is usually fashioned from a durable material that includes texturing to improve traction.

In addition to the upper and the sole, a heel counter is often provided at the rear of the footwear. The heel counter is contoured to wrap around the user's heel and along the sides of the footwear to provide stability and support for the user's heel. The upper wraps around the rear exterior surface of the heel counter and is typically secured to the heel counter.

Shoes are typically manufactured with each portion of the shoe, the upper and the sole, prepared according to a standardized set of sizes. However, the size of a wearer's foot may not conform precisely to the standardized sizes, so customization of the shoe is desirable. Additionally, in high-performance settings, such as while playing a sport, it may be desirable to optimize the performance characteristics of the shoe, such as stability when turning, impact absorption, etc. One way to customize shoe fits is to use inserts.

Auger et al. (U.S. patent application publication number US 2006/0010718 A1, the entirety of which is incorporated herein by reference thereto) discloses an article of footwear having a heel counter attached to the upper with a removable heel pad which may be secured to the heel counter. The heel pad is used to help improve the fit about a user's heel. However, the customization of fit and performance in Auger et al. is limited to the heel section of the article of footwear.

In general, there is a need in the art for a system for customizing an article of footwear in both the heel region and along the length of the article of footwear. The use of such a system can allow for customization of fit or optimization for the use of the article footwear for a particular purpose, such as for playing a particular position in a sport.

In addition, modern footwear generally requires two competing and often contradictory demands: specific stiffness and reduced weight. Specific stiffness refers to stiffness per unit weight. Generally, increasing specific stiffness and durability requires additional material and, subsequently, additional weight. Reducing weight generally requires reducing material and in turn, sacrificing strength. To meet the need for increasing strength and durability, while at the same time, reducing weight, designers have proposed the use of composite materials, usually in the form of a composite plate.

While composite materials provide increased strength without increased weight, their use in articles of footwear has been difficult to implement and limited. The composite plate is usually only found in one portion of the footwear, usually either in the heel or the forefoot. Though partial composite plates provide the necessary structure in the desired region of the footwear while allowing the footwear to remain lightweight, full length composite plates have not been previously used as part of any type of athletic footwear. This is due to the particular structure of some composite materials, which often rupture or buckle under the stresses encountered during normal use. In particular, previous composite plates have been too rigid and inflexible, and could not be used where flexibility was required.

Vas (U.S. Pat. No. 6,425,193) discloses a full length composite plate that is composed of a metal matrix containing graphite and ceramic which is impregnated with a metal alloy. This sort of composite plate does not meet the requirement of being lightweight, as is most desirable in many types of footwear, including those used by athletes.

In general, there is a need for a lightweight full length composite plate that could be used as the primary structural component of various types of footwear. The desired full length composite plate would allow for maximum support in the heel and arch and provide proper structure and flexibility in the forefoot region, while at the same time, helping to maintain the desired weight reduction.

SUMMARY OF THE INVENTION

An article of footwear including a customization system is disclosed. In one aspect, the invention provides an article of footwear comprising: an insert and a heel member; the heel member and the insert are attached forming an insert system; and wherein the insert system is attached to an interior surface of the article of footwear.

In another aspect, the heel member and the insert are attached using a mechanical fastener.

In another aspect, the heel member includes a hole.

In another aspect, the hole of the heel member is configured to receive a protruding region disposed on the insert.

In another aspect, the protruding region is generally circular and the hole is generally round.

In another aspect, the protruding region is larger than the hole thereby creating an interference fit.

In another aspect, the outer surface of the insert system is smooth.

In another aspect, the heel member includes a first releasable fastener configured to attach to a second releasable fastener fixed to the inside surface of a footwear collar.

In another aspect, the invention provides an insert for customizing an article of footwear comprising: a heel member configured to be removably insertable into a heel section of an upper of the article of footwear; and an insole portion attachable to the heel member and extending from the heel member towards a toe section of the upper of the article of footwear.

In another aspect, the heel member is attached to the heel section of the upper.

In another aspect, the heel member is attached to the upper with a hook-and-loop connector.

In another aspect, a section of the hook-and-loop connector is flush-mounted to the heel member, and wherein a corresponding section of the hook-and-loop connector is flush-mounted to the upper.

In another aspect, the insole portion is interference fitted to the heel member.

In another aspect, the insole portion is substantially flush to a sole portion of the article of footwear when inserted into the article of footwear.

In another aspect, the insert customizes a fit of the article of footwear.

In another aspect, the insert customizes at least one performance characteristic of the article of footwear.

In another aspect, the invention provides a method of assembling an article of footwear comprising the steps of: selecting a heel member from a plurality of candidate heel members; selecting an insert from a plurality of candidate insert members; attaching the selecting heel member with the selected insert forming an insert system; placing the insert system inside the article of footwear.

In another aspect, the step of attaching the selected heel member with the selected insert includes a step of assembling a mechanical joint.

In another aspect, the step of assembling the heel member and the insert includes a step of placing a protruding region associated with the insert into a hole associated with the heel member.

In another aspect, the step of assembling the heel member and the insert includes a step of attaching the heel member to the article of footwear through a releasable fastener system.

Another aspect provides an article of footwear including a full length composite plate is disclosed. In one aspect, the invention provides an article of footwear comprising: an upper and an outsole assembly; the outsole assembly including a full length composite plate; and where the full length composite plate has a percent elongation greater than 2 percent.

In another aspect, the percent elongation is greater than 3 percent.

In another aspect, the full length composite plate comprises a first material and a second material.

In another aspect, the first material is lightweight and flexible and the second material is more rigid than the first material.

In another aspect, the full length composite plate includes a first layer comprised of the first material and is attached to the second layer comprised of the second material.

In another aspect, the second layer is comprised of the second material and is attached to a first layer one side and a third layer on a second side.

In another aspect, the third layer is comprised of the first material and is attached to the second layer and a fourth layer, wherein the fourth layer is comprised of the second material.

In another aspect, the fourth layer is comprised of the second material and is attached to the third layer and a fifth layer.

In another aspect, the fifth layer is comprised of the first material and is attached to the fourth layer and a sixth layer.

In another aspect, the sixth layer is comprised of the second material and is attached to the fifth layer and a seventh layer.

In another aspect, the seventh layer is comprised of the first material.

In another aspect, the first material is TPU.

In another aspect, the second material is a woven carbon fiber.

In another aspect, the first layer is disposed adjacent to a first tie layer.

In another aspect, the seventh layer is disposed adjacent to a second tie layer.

In another aspect, the first and second tie layers have a thickness of 100 microns.

In another aspect, the invention provides an article of footwear comprising: an upper and an outsole assembly; the outsole assembly including a full length composite plate; the full length composite plate comprising a first portion and a second portion; and where the first portion is more flexible than the second portion.

In another aspect, the first portion is associated with the forefoot.

In another aspect, the first portion is a forefoot region.

In another aspect, the first portion is an arch region.

In another aspect, the first portion is a heel region.

In another aspect, the invention provides an article of footwear comprising: an upper and an outsole assembly; the outsole assembly including a full length composite plate; the composite plate having an arch region associated with the arch of a foot; the arch region including a lateral portion, a medial portion, and a central portion disposed between the lateral portion and the medial portion; and where the arch region includes at least one angled portion.

In another aspect, the at least one angled portion is disposed along the central portion.

In another aspect, the at least one angled portion is disposed along the lateral portion.

In another aspect, the at least one angled portion is disposed along the medial portion.

In another aspect, the invention provides an article of footwear comprising: an upper and an outsole assembly; the outsole assembly including a full length composite plate; the composite plate including a heel region associated with the heel of the foot; the heel region including an outer periphery and a central portion; the outer periphery including a medial portion, a lateral portion, and a rear portion; and where a portion of the outer periphery is angled with respect to the central portion.

In another aspect, the angled portion of the outer periphery is disposed on the lateral portion.

In another aspect, the angled potion of the outer periphery is disposed on the medial portion.

In another aspect, the angled portion of the outer periphery is disposed along the rear portion.

In another aspect, the invention provides an article of footwear comprising: an upper and an outsole assembly; the outsole assembly including a full length composite plate; the full length composite plate including an outer material; the outsole assembly also including tread elements; and where the tread elements are secured directly to the outer material of the full length composite plate.

In another aspect, the outer material and the tread elements comprise the same material.

In another aspect, the outer material and the tread elements comprise different materials.

In another aspect, the invention provides a method of making an article of footwear comprising the steps of: associating a full length composite plate with a first side of a molding base, a first surface of the full length composite plate confronting the first side of the molding base, the full length composite plate also including a second surface disposed opposite the first surface; associating a first side of an upper mold with the first side of the molding base, enclosing the full length composite plate within a central cavity disposed within the upper mold; filling the central cavity with a liquid or viscous substance through at least one injection channel in the upper mold; and where the liquid or viscous substance fills substantially the entirety of the central cavity and contacts the second side of the full length composite plate.

In another aspect, the central cavity contains at least one secondary cavity disposed along, and in fluid communication with, an outer periphery of the central cavity.

In another aspect, the secondary cavity is shaped for molding a traction element.

In another aspect, the upper mold is compressed against the molding base under enough pressure to keep the liquid or viscous substance confined to a region bounded by the central cavity and a portion of the molding base exposed to the central cavity.

In another aspect, a central cavity rim disposed along the first side of the upper mold has a perimeter larger than a perimeter of the first surface of the full length composite plate.

In another aspect, the central cavity includes more than one injection channel.

In another aspect, the invention provides an article of footwear comprising: an outsole assembly; the outsole assembly including a full length composite plate; and where the full length composite plate has a flex angle between 5 and 70 degrees.

In another aspect, the full length composite plate has a flex angle between 15-30 degrees.

In another aspect, the full length composite plate has a flex angle between 37-42 degrees.

In another aspect, the full length composite plate has a flex angle greater than 15 degrees.

In another aspect, the full length composite plate has a flex angle greater than 15 degrees.

In another aspect, the full length composite plate has a flex angle greater than 30 degrees.

In another aspect, the full length composite plate has a flex angle greater than 45 degrees.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

An insert for customizing an article of footwear is provided to customize fit or performance of the article of footwear. In some cases, a customizable insert for the insole and a heel member are used. The insert and heel member may also add additional support or cushioning for the foot while inside an article of footwear, so that these performance characteristics of the article of footwear are optimized for high-performance use of the article of footwear. For example, an insert may provide some extra cushioning between the foot and a full-length composite plate to reduce stresses to the foot. In addition, by inserting a heel member with the insole, extra support is provided to the heel to prevent slipping within the article of footwear.

Figure 1:
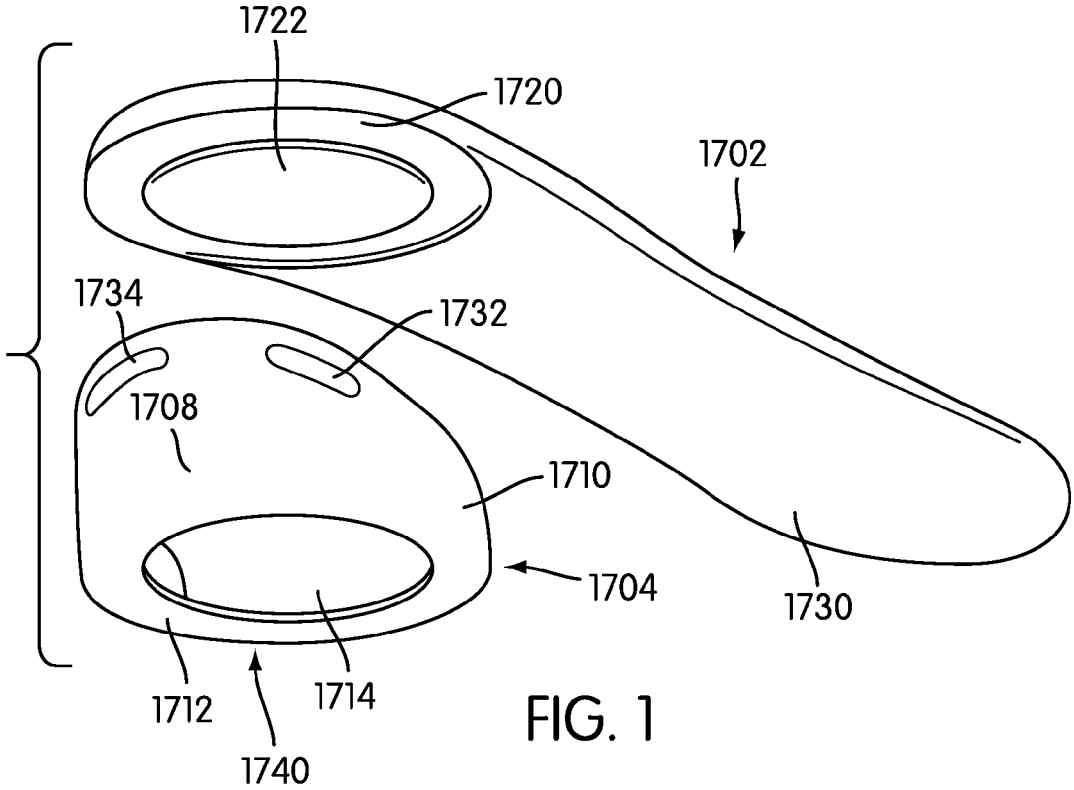
FIG. 1 is an exploded isometric view of a preferred embodiment of an insert and a heel member.

FIG. 1 is an exploded isometric view of a preferred embodiment of insert 1702 and heel member 1704 as viewed from below. Insert 1702 is preferably made of some material that provides cushioning for the foot, reducing stresses that may be applied to the foot during motion. Insert 1702 is preferably made of a lightweight and flexible material that can cover, substantially cover, or replace an insole of an article of footwear. Heel member 1704 is shaped to fit around the heel. Heel member 1704 is also preferably made of a lightweight and flexible material. Insert 1702 and heel member 1704 need not be composed of the same material.

Heel member 1704 includes rear extension 1708 and lateral extension 1710. It also includes a medial extension, not shown in FIG. 1. Additionally, heel member 1704 includes heel member base 1712, in which hole 1714 is disposed. Lateral extension 1710, rear extension 1708 and the medial extension are all disposed at an angle to heel member base 1712. Rear extension 1708 is disposed between, and at an angle to, lateral extension 1710 and the medial extension. Heel member base 1712 includes first base surface 1740 and a second base surface (not shown.) In a preferred embodiment, heel member 1704 can also include an inner wrap, not shown here, which provides extra cushioning for the heel.

In some embodiments, a means of fastening heel member 1704 to the inside of an article of footwear is provided. In a preferred embodiment, heel member 1704 includes first recessed portion 1732, disposed on lateral extension 1710. Heel member 1704 also includes second recessed portion 1734, disposed along rear extension 1708. Heel member 1704 also includes a third recessed region, disposed along the medial extension, not shown here.

As seen in FIG. 1, insert 1702 includes recessed portion 1720 at the rear of insert 1702. Insert 1702 also includes central protruding region 1722 at the rear of insert 1702. Central protruding region 1722 is disposed with respect to first insert surface 1730 of insert 1702 in a way that allows for central protruding region 1722 to be flush with first insert surface 1730. In a preferred embodiment, central protruding region 1722 is simply a region of first insert surface 1730 that has not been removed in the creation of recessed portion 1720.

Figure 2:
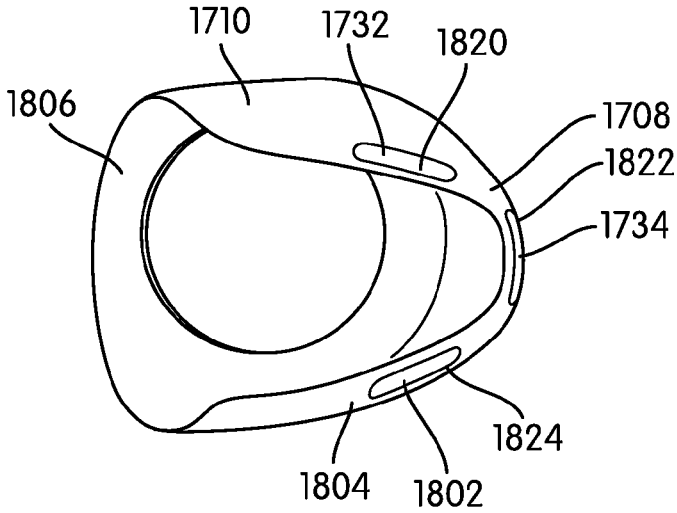
FIG. 2 is a plan view of a preferred embodiment of a heel member.

FIG. 2 is a plan view of a preferred embodiment of heel member 1704. First recessed region 1732, second recessed region 1734, and third recessed region 1802 are disposed along lateral extension 1710, rear extension 1708, and medial extension 1804, respectively. In some embodiments, a first releasable fastener 1820 may be inserted into first recessed region 1732. Likewise, a second releasable fastener 1822 may be inserted into second recessed region 1734. Likewise, a third releasable fastener 1824 may be inserted into third recessed region 1802. In some embodiments, first releasable fastener 1820, second releasable fastener 1822, and third releasable fastener 1824 may be a low-profile hook or loop portion of a hook-and-loop releasable fastener. In a preferred embodiment, a low-profile Velcro® strip may be used as a releasable fastener, either hook or loop. Heel member 1704 further includes second base surface 1806 of heel base 1712.

Figure 3:
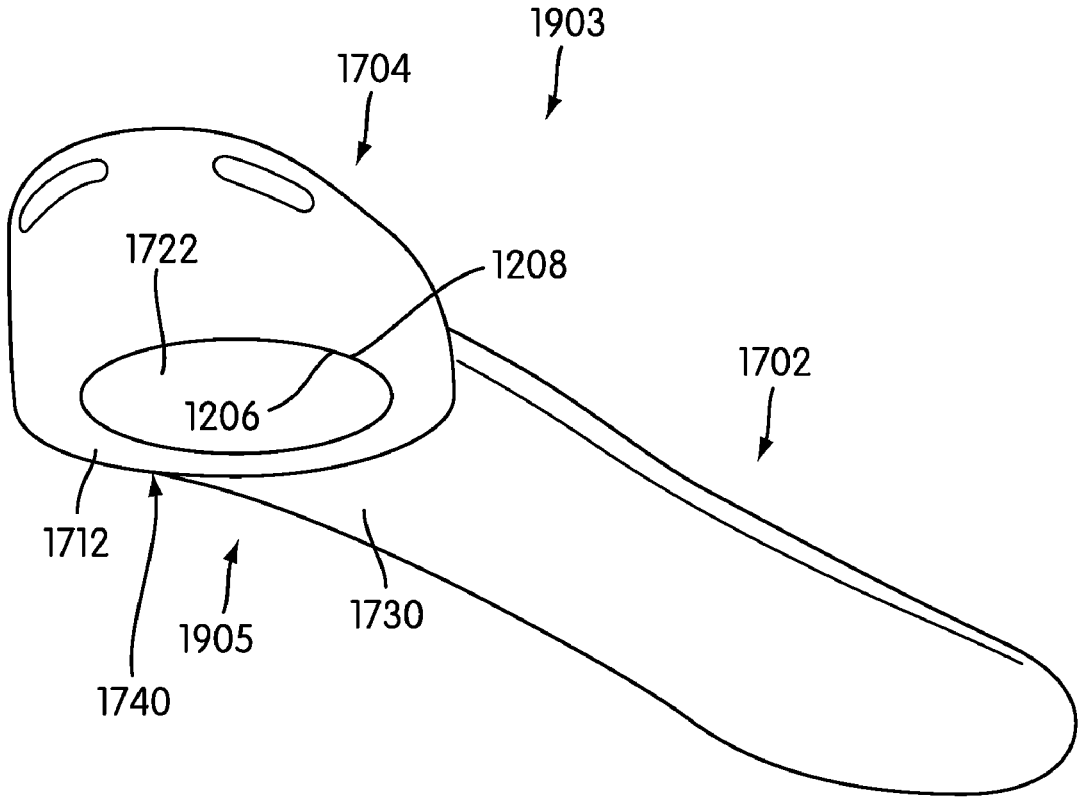
FIG. 3 is an isometric view of a preferred embodiment of an insert and a heel member.

FIG. 3 is an isometric view of a preferred embodiment of insert 1702 and heel member 1704 joined together as viewed from below. When joined together, heel member 1704 and insert 1702 may be referred to collectively as insert system 1903. The recessed portion (not shown in FIG. 3) of insert 1702 contacts the second base surface of heel member base 1712. Central protruding region 1722 fits inside hole 1714 of heel member 1704. This allows insert 1702 and heel member 1704 to be joined. Preferably, the recessed portion of insert 1702 and heel member base 1712 comprise the same thickness, so that first base surface 1740 is disposed flush with first insert surface 1730 of insert 1702. In other words, outer surface 1905, comprised of first insert surface 1730 and first base surface 1740 is smooth. In some embodiments, first rim 1206 of protruding region 1722 is made slightly larger than second rim 1208 of heel member hole 1714. This allows for an interference fit between central protruding region 1122 and heel member 1704.

In some embodiments, there may be more than one central protruding region included in insert 1702, and more than one hole included in heel member 1704. Multiple protruding regions and cutouts may be used in a fashion similar to central protruding region 1722 and hole 1714 to give multiple interference fits that allow heel member 1704 to be joined with insert 1702.

Figure 4:
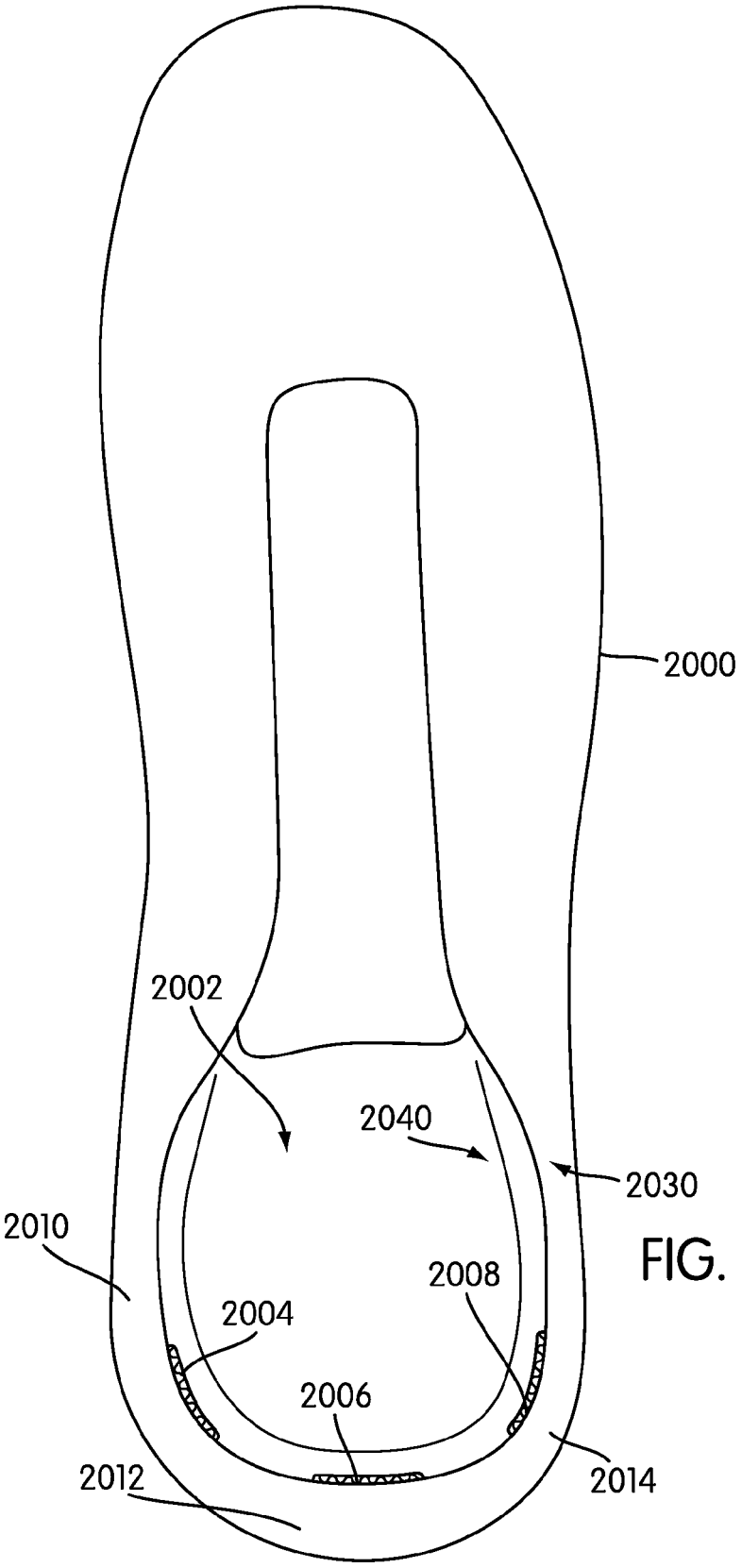
FIG. 4 is a plan view of a preferred embodiment of an article of footwear.

FIG. 4 is a plan view of a preferred embodiment of an article of footwear 2000. Article of footwear 2000 includes opening 2002. Opening 2002 is configured to receive the foot of a wearer. Article of footwear 2000 includes collar 2030. Opening 2002 is also where an insert and a heel member may be inserted into article of footwear 2000.

In some embodiments, article of footwear 2000 includes a releasable fastener attached to inside surface 2040 of collar 2030. In a preferred embodiment, article of footwear 2000 includes several attachment regions, each with a separate releasable fastener.

In the embodiment shown here, article of footwear 2000 includes first attachment region 2004, disposed just inside opening 2002, along medial side 2010 of article of footwear 2000. Article of footwear 2000 also includes second attachment region 2006, disposed just inside opening 2002, along the rear side 2012 of article of footwear 2000, and article of footwear 2000 also includes third attachment region 2008, disposed just inside opening 2002, along lateral side 2014 of article of footwear 2000. First attachment region 2004 preferably includes a low-profile hook or loop releasable fastener. Similarly, second attachment region 2006 preferably includes a low-profile hook or loop releasable fastener. Similarly, third attachment region 2008 preferably includes a low-profile hook or loop releasable fastener. If a low-profile hook releasable fastener is used with the heel member, a low-profile loop releasable fastener is also preferably used in all three attachment regions of article of footwear 2000. If a low-profile loop releasable fastener is used with the heel member, a low-profile hook releasable fastener is preferably used in all three attachment regions of article of footwear 2000. In a preferred embodiment, the releasable fastener system is Velcro®.

Figure 5:
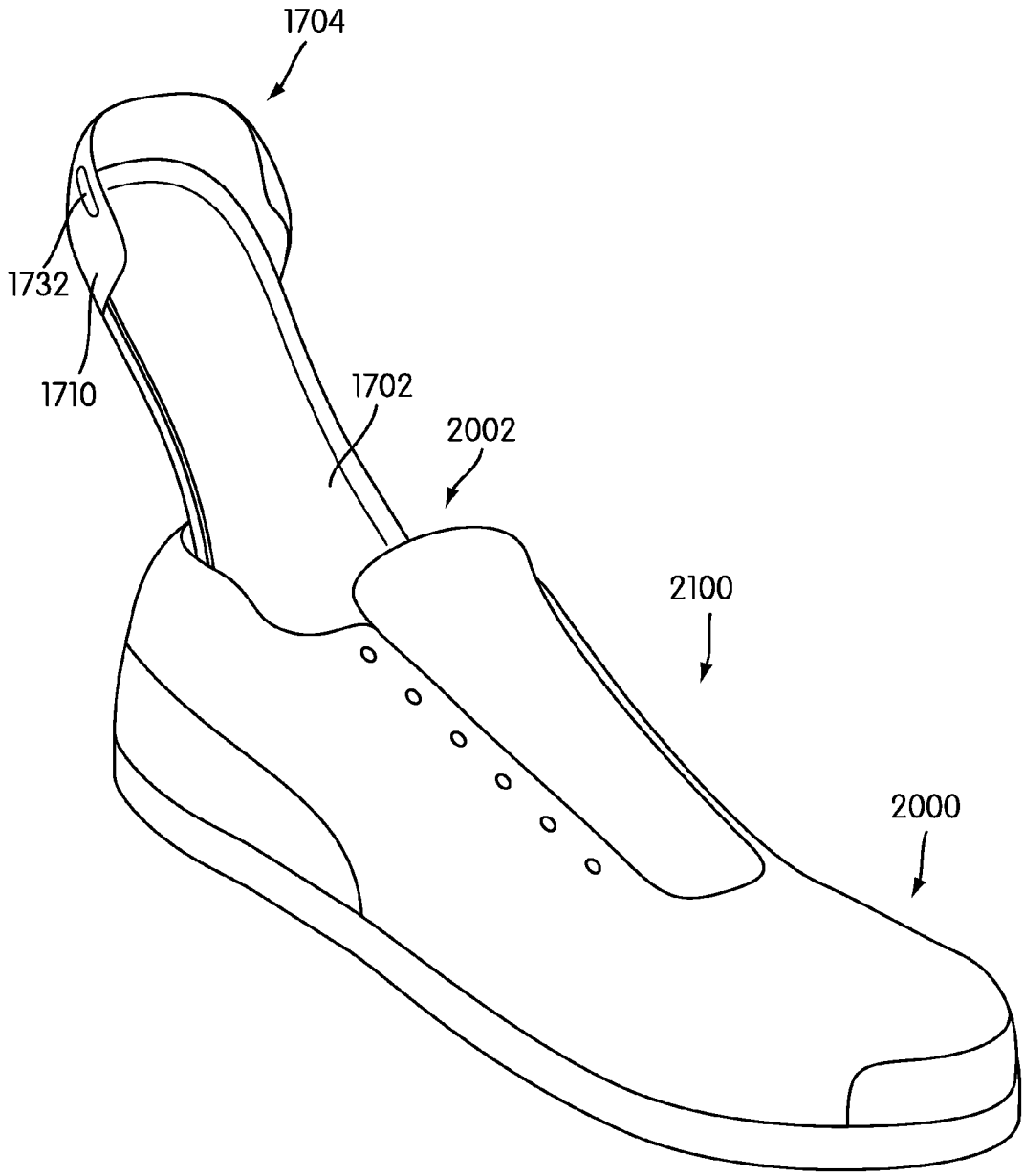
FIG. 5 is an isometric view of a preferred embodiment of an insert and heel member being placed inside an article of footwear.

FIG. 5 is an isometric view of a preferred embodiment of footwear system 2100 with heel member 1704, insert 1702, and article of footwear 2000. Heel member 1704 and insert 1702 are preferably joined prior to insertion in article of footwear 2000. Insert 1702 with joined heel member 1704 are preferably inserted into article of footwear 2000 using footwear opening 2002. In a preferred embodiment, insert 1702 is shaped like the last of the article of footwear so that insert 1702 extends into article of footwear 2000 and preferably lies substantially flush with the sole.

Figure 6:
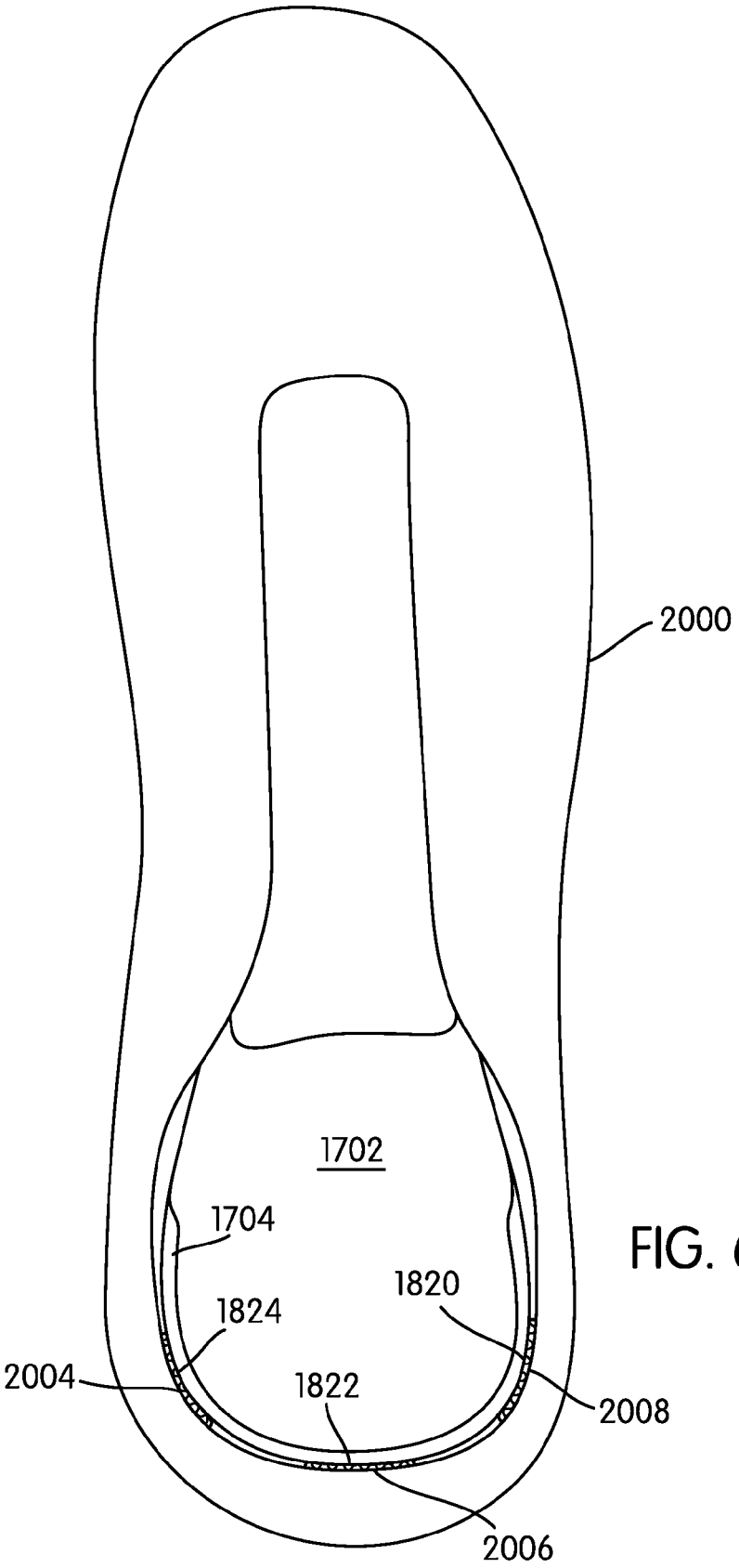
FIG. 6 is a plan view of a preferred embodiment of an article of footwear with a heel member attached.

FIG. 6 is a plan view of a preferred embodiment of article of footwear 2000, after heel member 1704 and insert 1702 have been inserted through opening 2002. First releasable fastener 1820 of heel member 1704 is attached to third attachment region 2008 of article of footwear 2000. Second releasable fastener 1822 of heel member 1704 is attached to second attachment region 2006 of article of footwear 2000. Third releasable fastener 1824 of heel member 1704 is attached to first attachment region 2004 of article of footwear 2000. Shown schematically in FIG. 6 as protruding slightly from article of footwear 2000 for clarity, the outer surfaces of first attachment region 2004, second attachment region 2006, and third attachment region 2008 are preferably flush with the outer surface of article of footwear 2000 on an inside portion of collar 2030. Similarly, the outer surfaces of the corresponding fasteners on heel member 1702, fasteners 1820, 1822, and 1824, are also substantially flush with an outer surface of heel member 1702. Using this arrangement of releasable fasteners, heel member 1704 is attached to article of footwear 2000. Because insert 1702 is preferably attached to heel member 1704, the releasable fasteners also help to secure insert 1702 to article of footwear 2000.

Insert 1702 and heel member 1704 can be interchanged to suit the user's needs. Heel member 1704 may come in a variety of different shapes and sizes, and be interchanged to accommodate different heel sizes or provide different kinds of support or impact resistance. Similarly, insert 1702 may also come in a variety of different shapes and sizes, and also may be interchanged in order to allow the user to change the thickness of the insert or type of material. Using this interchangeable system, users can select an appropriate insert 1702 and an appropriate heel member 1704, assemble the two, and install the system into article of footwear 2000 to achieve a customized fit.

It is preferable that a second insert and heel member are made in mirror image of insert 1702 and heel member 1704 to be inserted into an article of footwear made in the mirror image of article of footwear 2000 to form a pair. In another embodiment, the second insert and/or heel member may be of different sizes than insert 1702 and heel member 1704, such as to compensate for a wearer's differently-sized feet.

In a preferred embodiment, insert 1702 and/or heel member 1704 may be used to customize the fit or performance characteristics of an article of footwear including a full-length composite plate. In an exemplary embodiment, insert 1702 and/or heel member 1704 may be used in combination with the article of footwear including a full-length composite plate described in U.S. patent application Ser. No. 11/456,178, filed Jul. 7, 2006, now abandoned, the entirety of which is incorporated herein by reference thereto.

A full length composite plate is disclosed here. The term "full length composite plate" as used throughout the entirety of this specification, including the claims, is defined as any composite plate which can provide support to portions of the forefoot, portions of the arch, and portions of the heel of the foot simultaneously.

Figure 7:
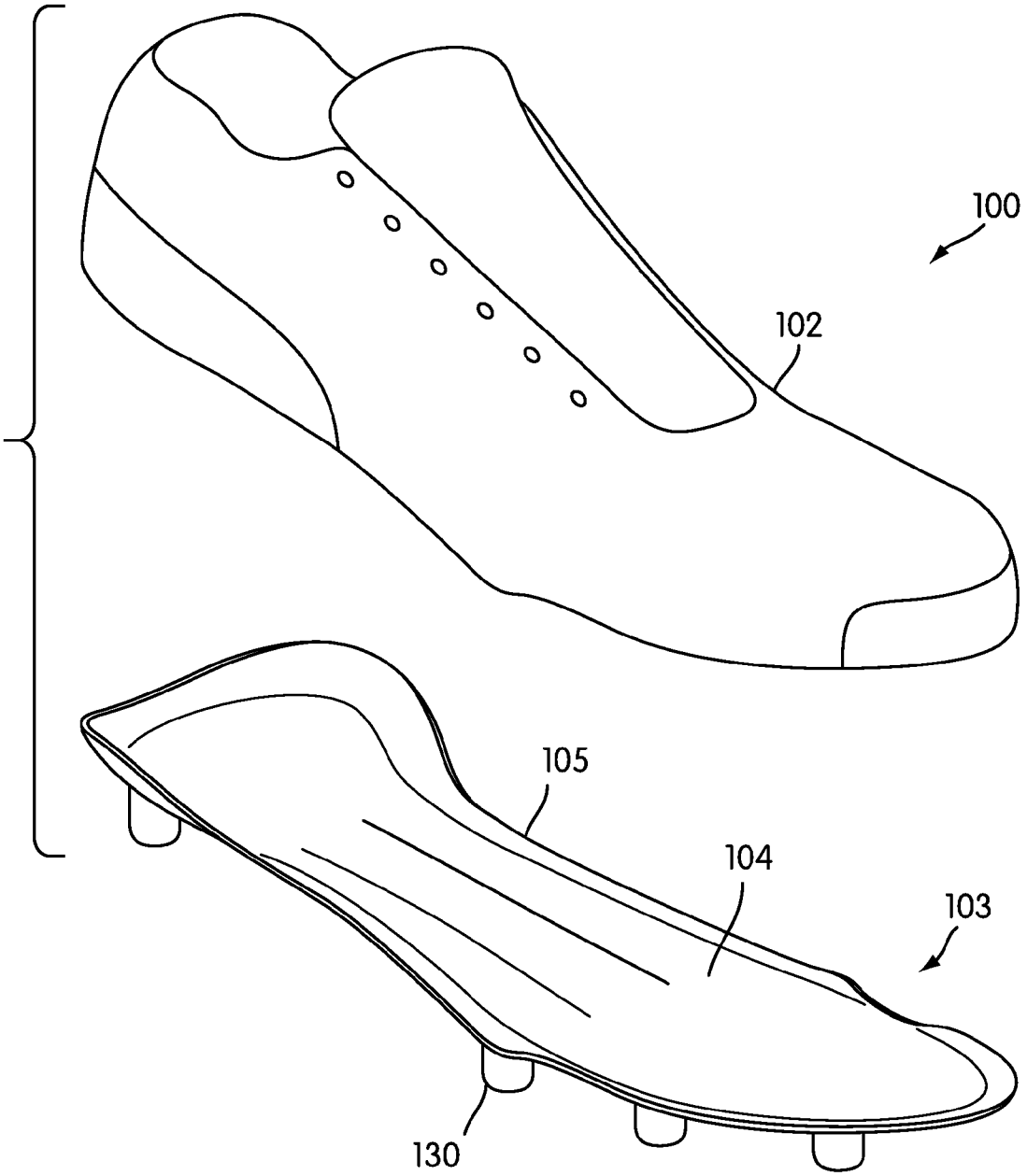
FIG. 7 is an exploded view of a preferred embodiment of an article of footwear.

FIG. 7 shows an exploded view of a preferred embodiment of an article of footwear 100. Article of footwear 100 includes an upper 102. Upper 102 could be made of any material, preferably a lightweight fiber. In some embodiments, upper 102 is composed of many different materials. Article of footwear 100 includes outsole assembly 103. Outsole assembly 103 includes full length composite plate 104. Article of footwear 100 may be a running shoe, a soccer shoe, a cross training shoe, a basketball shoe or any other article of footwear. Although in this embodiment there is no midsole, some embodiments may include a midsole.

In some embodiments, outsole assembly 103 may include a tread element 130. Outsole assembly 103 may also include other kinds of tread elements. In some embodiments, these tread elements may be directly attached to full length composite plate 104. Full length composite plate 104 includes an outer material 105. In some embodiments, tread element 130 may be secured directly to outer material 105. Outer material 105 may comprise the same material as tread element 130, or outer material 105 may be composed of a different material. Similarly, multiple tread elements may be secured directly to outer material 105. The multiple tread elements may comprise the same or different materials than outer material 105.

Figure 8:
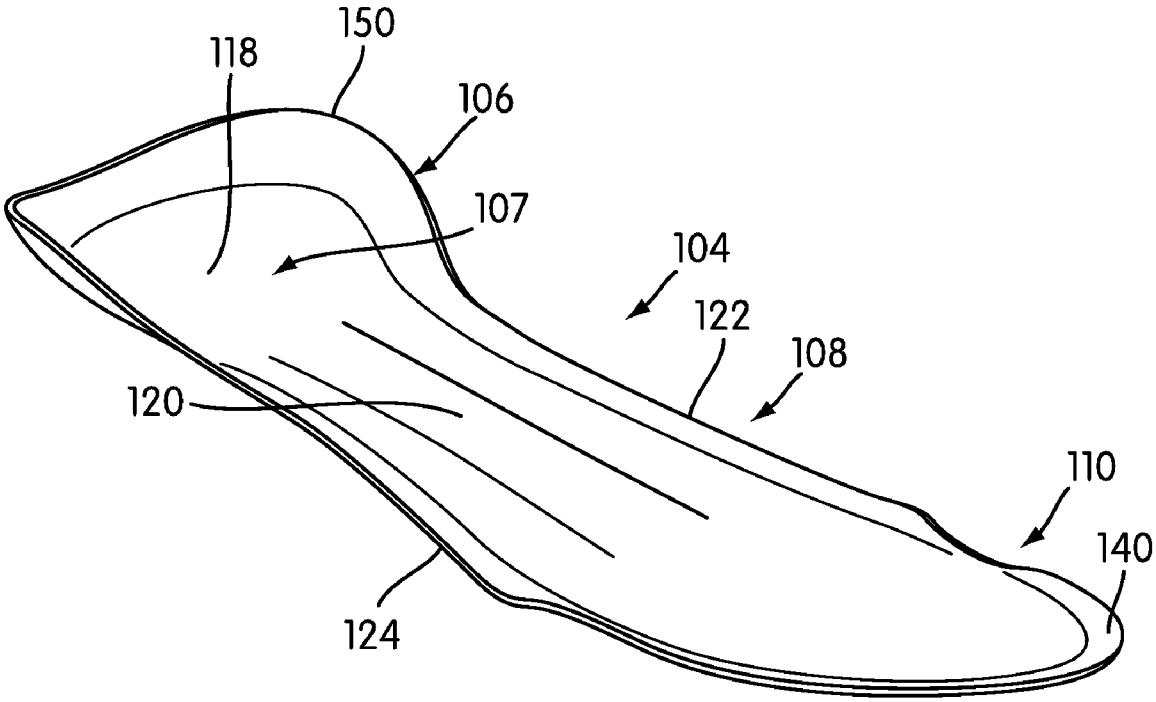
FIG. 8 is an isometric view of a preferred embodiment of a full length composite plate.

FIG. 8 is an isometric view of a preferred embodiment of full length composite plate 104. Full length composite plate 104 includes heel region 106, arch region 108 and forefoot region 110. Arch region 108 is disposed between heel region 106 and forefoot region 110. Heel region 106 includes heel cup 107. Heel cup 107 includes heel outer periphery 150 and central portion 118. Arch region 108 includes central portion 120. Arch region 108 also includes medial portion 122 and lateral portion 124. In some embodiments, forefoot region 110 may include raised forward rim 140.

Full length composite plate 104, shown in FIG. 8, is intended for an article of footwear designed for a wearer's right foot. Generally another full length composite plate that is the mirror image of composite plate 104 would be manufactured for an article of footwear designed for a wearer's left foot.

In the past, composite plates have generally been found only in a portion of an article of footwear. The composite plate may be placed in the region of the midsole that engages the heel, or it may be placed in the region of the article of footwear that engages the ball of the foot and toes. Under most circumstances, previous composite plates were unable to support the entire length of the foot simultaneously. This is because previous full length composite plates buckled or ruptured under normal stresses applied to an article of footwear during use. In other words, previous composite materials were too stiff and inflexible, and could only be used in small, localized areas.

However, it is possible to select a composite plate material from which a full length composite plate may be manufactured and used as a support structure for the forefoot, arch, and heel regions of the foot. A primary characteristic of the composite plate material is its percent elongation. Percent elongation is a standard measure of the ductility of a material. It represents the amount a material can be stretched along its primary axis before rupturing. Percent elongation is given by the following equation:

$$\text{Percent Elongation}=100(LR-L0)/L0$$

Here, LR represents the length of the material at the moment it has ruptured, while L0 represents the initial length of the material. These measurements are preferably taken with respect a central axis.

In a preferred embodiment, the percent elongation of a composite material to be used for a full length composite plate is 2 percent. In some embodiments, the percent elongation for a full length composite plate may be greater than 2 percent. In other embodiments, the percent elongation can be 3 percent or more.

Figure 9:
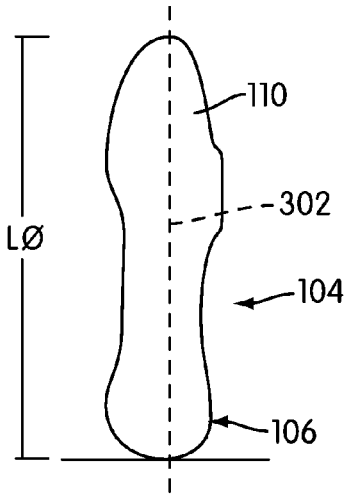
FIG. 9 is a plan view of a preferred embodiment of full length composite plate.

FIG. 9 shows a plan view of a preferred embodiment of full length composite plate 104 as viewed from above. In this embodiment, full length composite plate 104 is at rest (unstressed) and has a length L0, as measured along central axis 302 that runs from the tip of heel region 106 to the tip of forefoot region 110.

Figure 10:
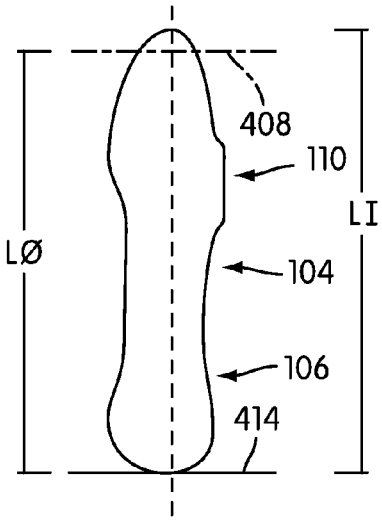
FIG. 10 is a plan view of a preferred embodiment of a full length composite plate stretched under tension.

FIG. 10 is a plan view of a preferred embodiment of full length composite plate 104 under tension along central axis 302. This tension may be accomplished by fixing the tip of heel region 106 to base 414 and pulling the opposite end with some tensioning device. Dotted line 408 represents the initial of position of tip forefoot region 110. The distance from dotted line 408 to base 414 is L0, the original length of full length composite plate 104. Now under tension, full length composite plate 104 has been elongated to a new intermediate length, LI. Here, full length composite plate 104 has been elongated by an amount (LI–L0). In this position, full length composite plate 104 has been deformed, but has not ruptured or failed.

Figure 11:
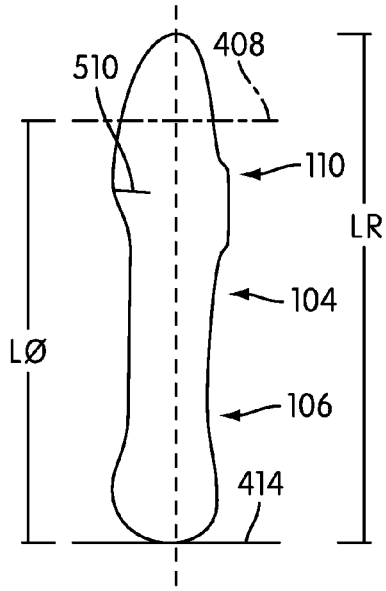
FIG. 11 is an isometric view of a preferred embodiment of a full length composite plate stretched under tension.

FIG. 11 is a plan view of a preferred embodiment of full length composite plate 104 under tension along central axis 302. Here, the stress applied to full length composite plate 104 has elongated it so that the distance between the tip of forefoot region 110 and base 414 is LR. At this length, full length composite plate 104 ruptures, as indicated schematically by small crack 510. In the embodiment shown in FIG. 11, full length composite plate 104 has been stretched by an amount (LR–L0); and small crack 510 is the first sign of rupturing. In other embodiments, full length composite plate 104 can fail by de-laminating, splitting, or by some other failure mode.

Figure 12:
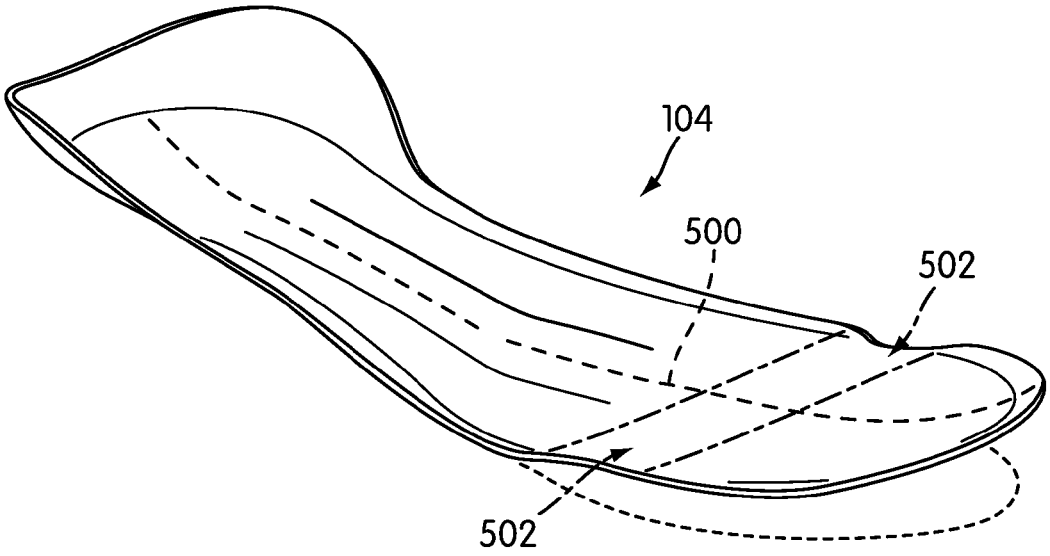
FIG. 12 is an isometric view of a preferred embodiment of full length composite plate bending.

It is unlikely that a full length composite plate serving as a portion of an article of footwear will experience direct tension along its primary axis. Instead, it is much more likely that the full length composite plate will bend in various ways. Preferably, a full length composite plate is constructed from materials that allow it to bend by a predetermined amount without rupturing. Referring to FIG. 12, a preferred embodiment of full length composite plate 104 may experience bending. As various stresses are applied to full length composite plate 104 by the foot and surface during the use of an article of footwear, bending may occur. Bending could occur anywhere within composite plate 104. In the example shown in FIG. 12, bending occurs at bending region 502. In particular, bending occurs with respect central axis 500. However, any other regions of full length composite plate 104 could be bent in similar ways due to the usual stresses applied to portions of the full length composite plate during the use of article of footwear 100.

Figure 13:
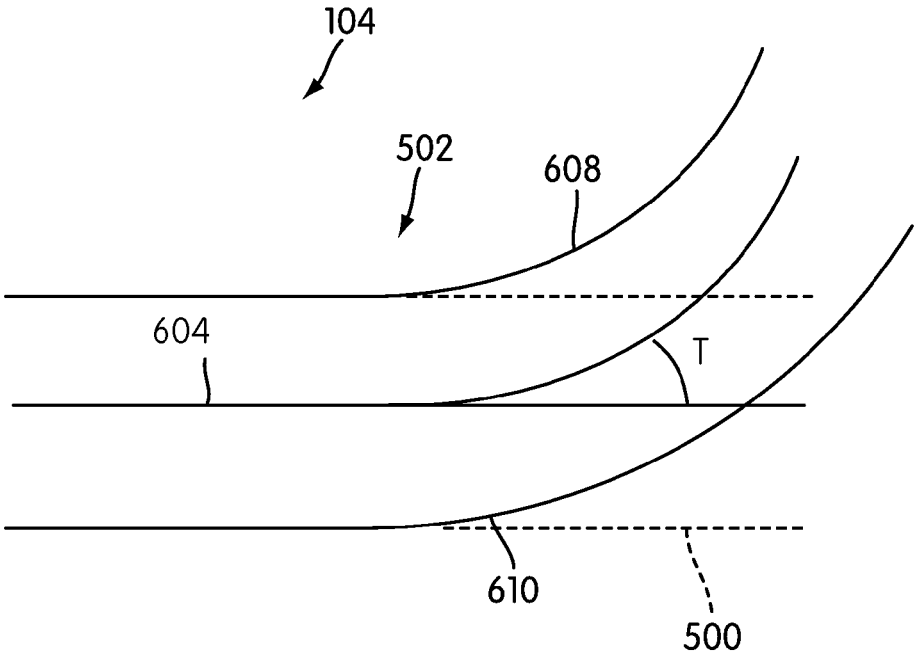
FIG. 13 is an enlarged view of a preferred embodiment of the region of full length composite bending.

FIG. 13 is an enlarged view of a preferred embodiment of bending region 502. In the embodiment shown in FIG. 13, inner side 608 of full length composite plate 104 is disposed closest to the foot during motion, and outer side 610 of full length composite plate 104 is disposed closest to the surface during motion. Typical motions that occur during the use of an article of footwear will result in bending of full length composite plate 104 in local regions, such as bending region 502.

In this embodiment, a portion of full length composite plate 104 has been bent away or flexed from its original position 500 by a flex angle T. During bending, compressive loads are applied to inner surface 608, while tensile loads are applied to outer surface 610. Neutral surface 604 is the surface through which there is no net force. Between neutral surface 604 and inner surface 608 compressive loads are increased along surfaces parallel to neutral surface 604, reaching a maximum at inner surface 608. Likewise between neutral surface 604 and outer surface 610 tensile loads are increased along surfaces parallel to neutral surface 604, reaching a maximum at outer surface 610. The area between neutral surface 604 and outer surface 610 is experiencing tensile loads and therefore will undergo some local elongation.

In general, the flex angle T of a composite plate is related to the strain $\epsilon$ applied to the composite plate. In particular, the strain $\epsilon$ is linearly related to the flex angle T of a composite plate. As the flex angle T of the composite material changes, so will the strain $\epsilon$. As an example, to accommodate a flex angle of 60 degrees, the necessary strain is $\epsilon$=2.9%.

Because strain is a measure of the change in length of a material, the relationship between strain and percent elongation is straightforward. Percent elongation is simply the amount of strain applied at the rupturing length of a material. Therefore, in order to accommodate a given flex angle T, the percent of elongation of a material should be greater than the strain caused by flex angle T.

During typical use of an article of footwear, bending will occur. Because bending involves local elongation of a material, materials comprising the article of footwear may rupture if they are stretched beyond their characteristic rupturing length. As part of an article of footwear, a full length composite plate may be designed to endure a predetermined amount of bending in local regions. The materials comprising the full length composite plate may be chosen from a set of candidate materials based on the predetermined amount of bending that the full length composite plate is expected to experience during use. In particular, acceptable candidate materials for full length composite plates can be selected based on a percent elongation criteria, as disclosed above. Also, acceptable materials for use as full length composite plates can be selected based on flex angle T.

Bending region 502 is used here only as an example of a region where full length composite plate 104 may undergo stresses that cause it to bend. Full length composite plate 104 may experience stresses that cause bending at many different regions. In all these regions, though bending may cause elongation in some portions, full length composite plate 104 is generally designed to withstand a certain percentage of elongation as previously discussed.

As previously discussed, an important characteristic to be considered in designing a full length composite plate is the flex angle. Depending on the use of the article of footwear, full length composite plates may be designed to accommodate different flex angles.

Generally, a full length composite plate should be able to accommodate flex angles between 5 and 70 degrees, depending on the application. Any article of footwear that needs to accommodate flex angles between 5 and 70 degrees may be designed using the characteristics of a full length composite plate disclosed in this specification. In a preferred embodiment, a full length composite plate may be configured to accommodate flex angles between 15-30 degrees. These are typical flex angles for a running shoe or a track shoe. In other embodiments, a full length composite plate may be configured to accommodate flex angles between 37-42 degrees. An example of a type of shoe that requires this range of flex angles is a soccer cleat.

In some embodiments, full length composite plate 104 comprises two distinct materials. In some embodiments, full length composite plate 104 comprises a layered structure. In those embodiments where full length composite plate includes at least two materials, full length composite plate 104 preferably includes a first distinct material that is lightweight and flexible, and a second distinct material that is more rigid than the first. In a preferred embodiment, the first material is thermoplastic urethane (TPU). In a preferred embodiment, the second material is a woven sheet of carbon fibers.

Figure 14:
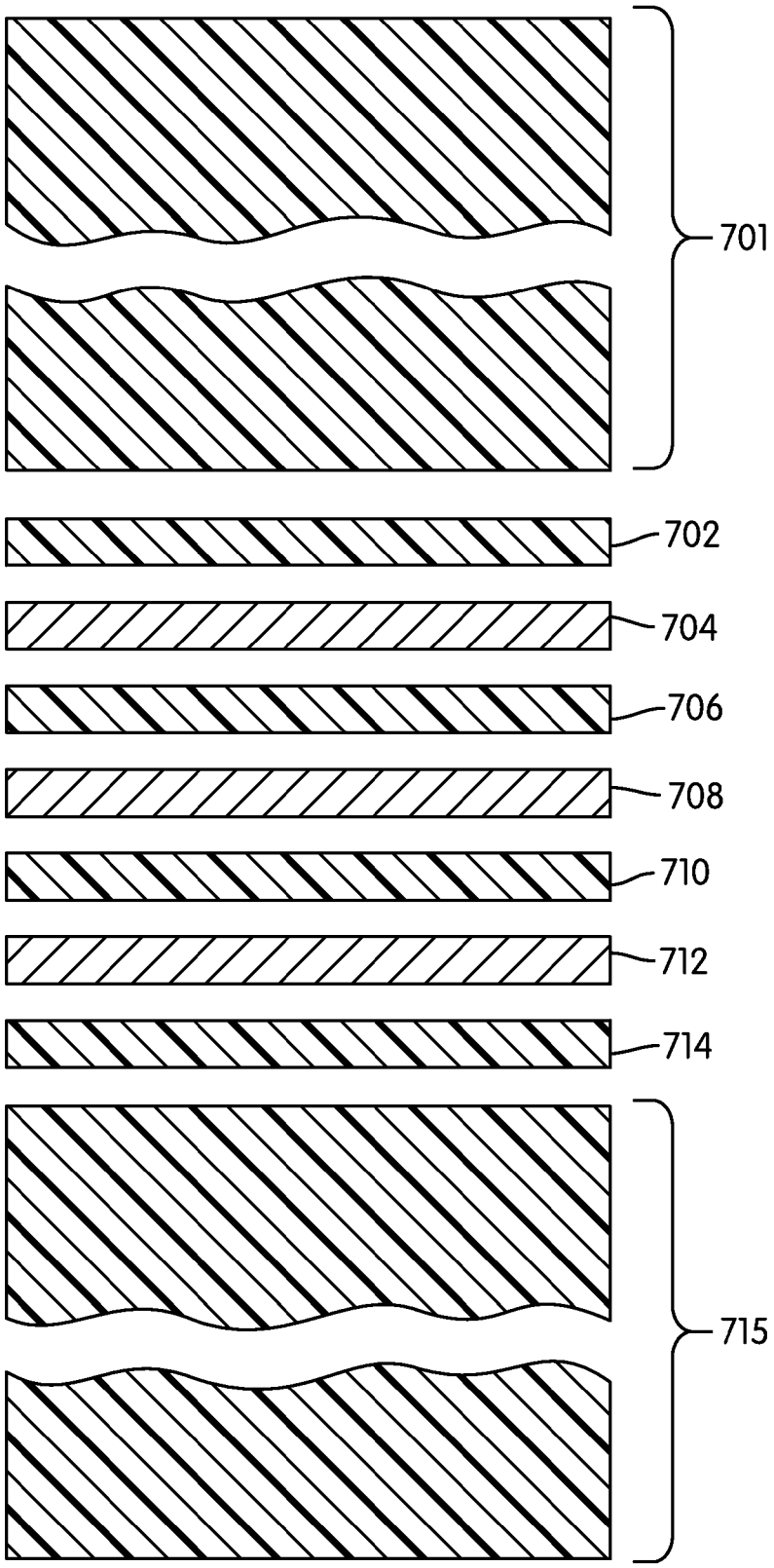
FIG. 14 is a cross sectional view of a preferred embodiment of the composite materials that are layered to form a full length composite plate.

FIG. 14 is a cross sectional side view of a preferred embodiment of the layering of the two distinct materials that comprise the full length composite plate. Preferably, the two distinct materials alternate in layers. First carbon fiber layer 704 is disposed between first TPU layer 702 and second TPU layer 706. Second carbon fiber layer 708 is disposed between second TPU layer 706 and third TPU layer 710. Third carbon fiber layer 712 is disposed between third TPU layer 710 and fourth TPU layer 714.

In a preferred embodiment (shown in FIG. 14), a first tie layer 701 may be disposed adjacent to first TPU layer 702. In a similar manner, a second tie layer 715 may be disposed adjacent to fourth TPU layer 714. First tie layer 701 and second tie layer 715 may be constructed of TPU as well. First tie layer 701 and second tie layer 714 are preferably much thicker than first TPU layer 702, second TPU layer 706, third TPU layer 710, and fourth TPU layer 714. In some embodiments, first TPU layer 702, second TPU layer 706, third TPU layer 710, and fourth TPU layer 714 are about seven microns thick, while first tie layer 701 and second tie layer 715 are approximately one hundred microns thick. One hundred microns is an optimized thickness at which the strength to weight ratio of a TPU layer in this environment is maximized.

Additionally, in a preferred embodiment, first tie layer 701 and second tie layer 715 have a lower melting point than the other TPU layers 702, 706, 710, 714. First tie layer 701 and second tie layer 715 may be bonded to a molding material, such as TPU.

In general, each fiber layer 704, 708 and 712 may be oriented differently. Preferably, the weave geometry comprising each fiber layer 704, 708 and 712 may be disposed at angles with respect to one another. By changing the relative orientation of the respective weave geometries, the structural properties of the full length composite plate may be modified.

Figure 15:
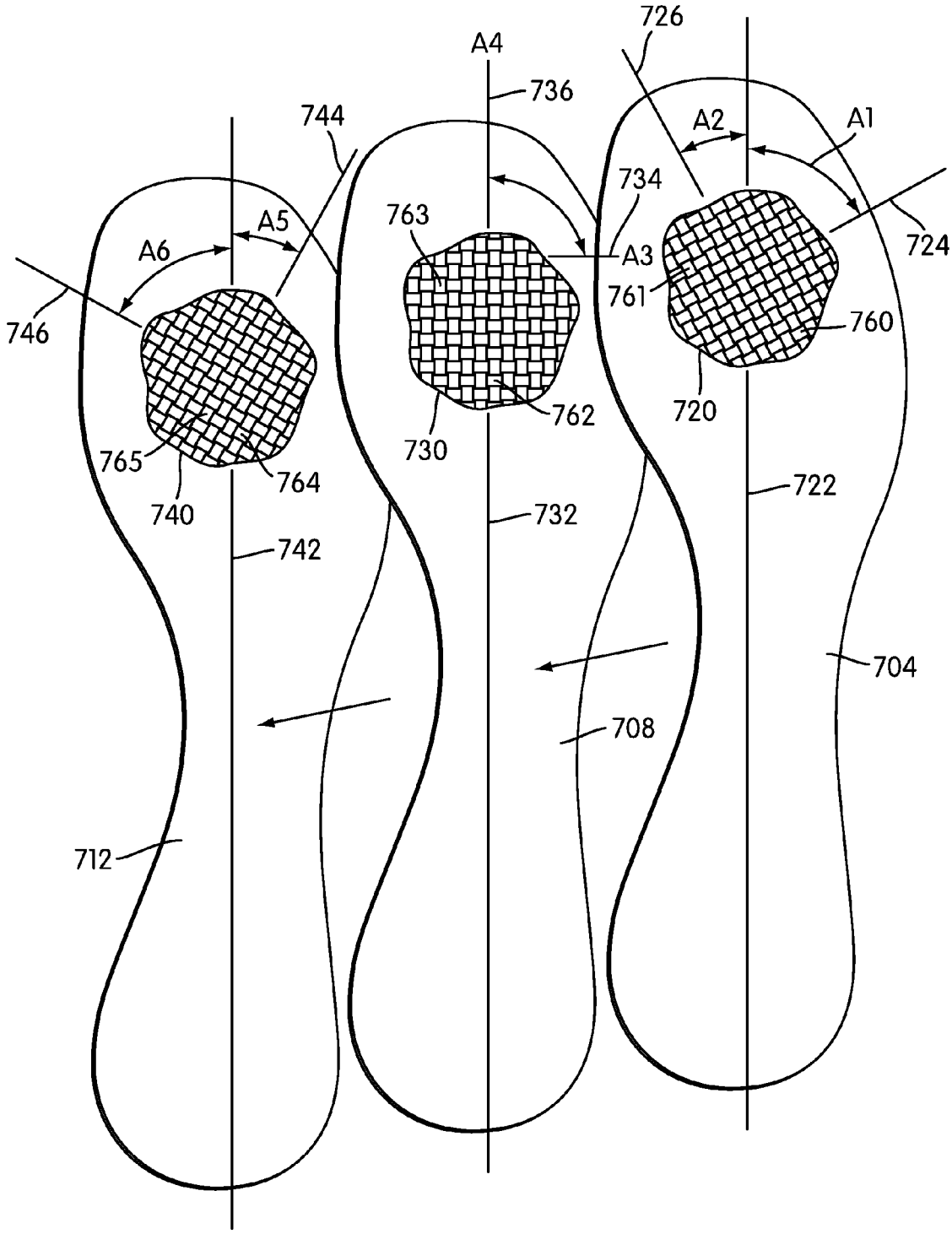
FIG. 15 is an oblique isometric view of a preferred embodiment of the layering structure of a composite materials in a full length composite plate.

Referring to FIG. 15, an illustrative embodiment of the orientation of first fiber layer 704, second fiber layer 708, and third fiber layer 712 is shown. Seen here as an exploded oblique view, each of the individual fiber layers 704, 708, 712 are preferably disposed so that the weaving patterns are oriented in different directions. In the following description, the term weft refers to the fibers in a weave oriented in a horizontal, or left to right direction. The term warp refers to the fibers in a weave oriented in a vertical or top to bottom direction. Generally, the weft and warp are always set at right angles to one another.

In the embodiment shown in FIG. 15, first fiber layer 704 includes first longitudinal axis 722, oriented along the length of the article of footwear. For clarity, a first portion 720 of the weaving pattern of first fiber layer 704 is shown. In a preferred embodiment, the weaving pattern comprises the entirety of first fiber layer 704. In a preferred embodiment, first weft 760 is set at a first angle A1 from first longitudinal axis 722. Likewise, first warp 761 is preferably set at a second angle A2 from first longitudinal axis 722.

In a preferred embodiment, second fiber layer 708 includes second longitudinal axis 732, oriented along the length of the article of footwear. As with first fiber layer 704, only a second portion 730 of the weaving pattern of second fiber layer 708 is shown. In a preferred embodiment, the weaving pattern comprises the entirety of second fiber layer 708. In a preferred embodiment, second weft 762 is set at a third angle A3 with respect to second longitudinal axis 732. Likewise, second warp 763 is preferably set at a fourth angle A4 from second longitudinal axis 732.

In a manner similar to first fiber layer 704 and second fiber layer 708, third fiber layer 712 preferably includes third longitudinal axis 742, oriented along the length of the article of footwear. As with the other fiber layers 704, 708, only a third portion 740 of the weaving pattern of third fiber layer 712 is shown. In a preferred embodiment, the weaving pattern comprises the entirety of third fiber layer 712. In a preferred embodiment, third weft 764 is set at a fifth angle A5 from third longitudinal axis 742. Likewise, third warp 765 is preferably set at a sixth angle A6 from third longitudinal axis 742.

In general, each angle A1, A2, A3, A4, A5, and A6 may be any angle. In some embodiments, the weft and warp angles will be identical for each of the fiber layers 704, 708, and 712. In a preferred embodiment, third angle A3 and fourth angle A4 are 90 and 0 degrees respectively. Also, second angle A2 and fifth angle A5 are preferably less than 45 degrees from their respective axes, while first angle A1 and sixth angle A6 are preferably between 45 and 90 degrees.

The characteristics of a full length composite plate may be modified by changing the orientation of each fiber layer with respect to one another. That is, by changing the angles A1, A2, A3, A4, A5, and A6. In some cases, the percent elongation of the full length composite plate may be modified by changing angles A1, A2, A3, A4, A5, and A6. In some cases, the flex angle of the full length composite plate may be modifies by changing angles A1, A2, A3, A4, A5, and A6.

In one a embodiment, to increase the flexibility of the full length composite plate, the weave orientation of each fiber layer 704, 708, and 712 may be similar and may be set at 45 degrees angles to a longitudinal axis. That is: A1 is +45 degrees, A2 is −45 degrees, A3 is +45 degrees, A4 is −45 degrees, A5 is +45 degrees and A6 is −45 degrees. This arrangement helps to improve flexibility.

Any suitable material could be used as the fiber layer. In an exemplary embodiment, a carbon fiber layer is used.

Figure 16:
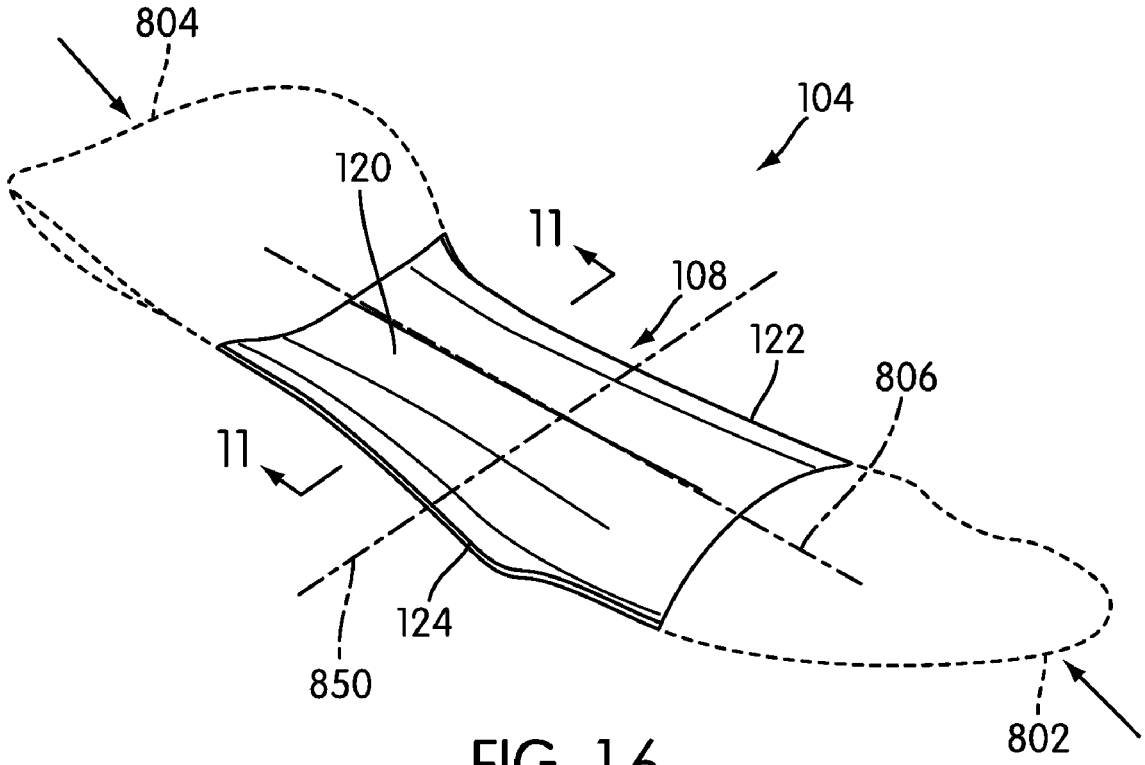
FIG. 16 is an isometric view of a preferred embodiment of an arch region of a full length composite plate.

Referring to FIG. 16, a preferred embodiment of arch region 108 may include medial portion 122 and lateral portion 124. Arch region 108 may also include central portion 120. Preferably, arch region 108 includes provisions to supply stiffness to the arch as well as provisions to minimize or eliminate buckling of full length composite plate 104. In some situations, compressive loads may be applied to full length composite plate 104 at forward region 802 and rear region 804, as seen in FIG. 16. These compressive loads may cause compression of full length composite plate 104 along central axis 806. If the compressive loads are strong enough, full length composite plate 104 may buckle.

Figure 17:
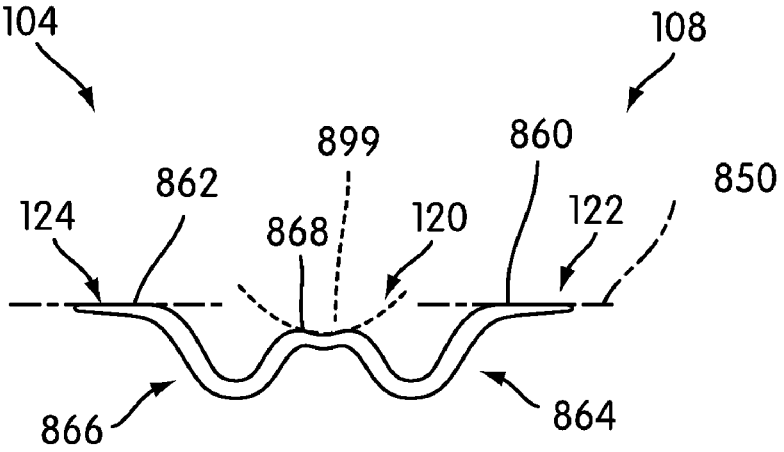
FIG. 17 is a cross sectional view of a preferred embodiment of an arch region of a full length composite plate.

Referring to FIG. 17, the geometry of full length composite plate 104 along arch region 108 is best seen in a cross sectional view. Preferably, medial portion 124 includes first flat portion 860. Likewise, lateral portion 122 preferably includes second flat portion 862. Central portion 120 preferably includes first angled portion 864 and second angled portion 866. Central portion 120 may also include rounded portion 868. Preferably, first flat portion 860 and second flat portion 862 are both generally coincident with surface 850. Rounded portion 868 preferably follows contour 899 of arch region 108 along the length of the article of footwear. In some embodiments, contour 899 may be the shape of the last of article of footwear 100. First angled portion 864 and second angled portion 866 are preferably not parallel to surface 850. In a preferred embodiment, first angled portion 864 and second angled portion 866 are both rounded.

In a preferred embodiment, first angled portion 864 and second angled portion 866 are configured to supply stiffness to arch region 108. In some embodiments, second angled portion 866 may be slightly larger in order to increase stability by slowing the rate of pronation along medial side 124. Furthermore, first flat portion 850 and second flat portion 862 are preferably configured to minimize or eliminate buckling when flexed.

Figure 18:
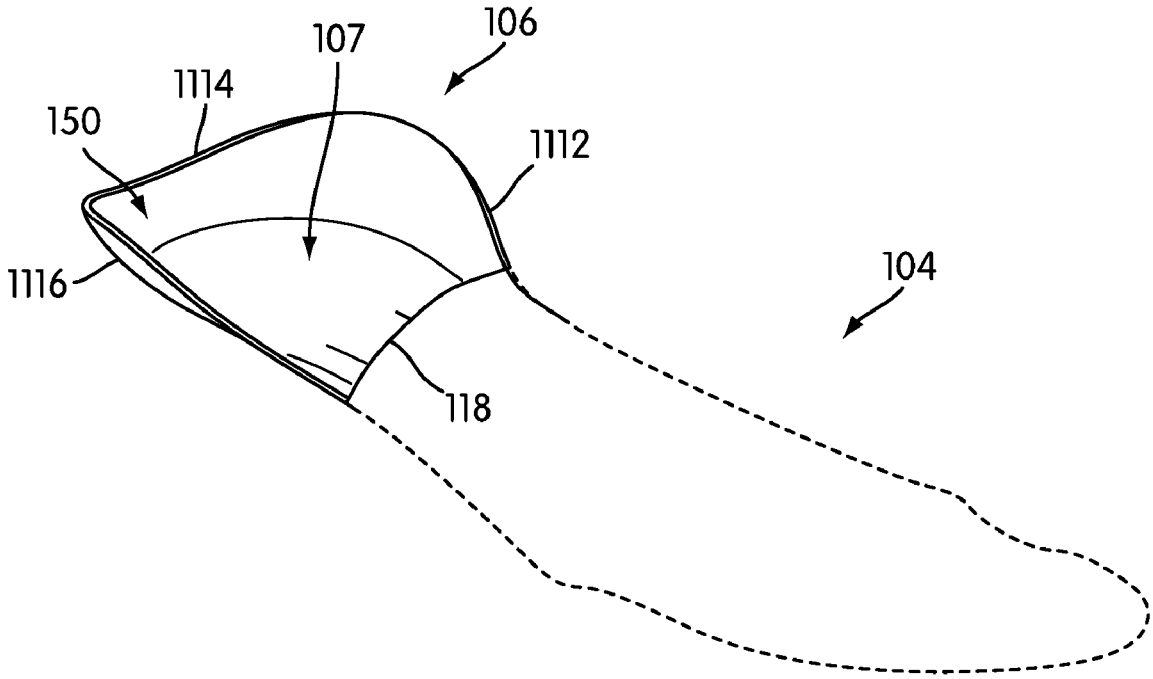
FIG. 18 is an isometric view of a preferred embodiment of a heel cup.

In a preferred embodiment, full length composite plate 104 includes provisions for increasing heel stability as well as for improving traction. Referring to FIG. 18, a preferred embodiment of heel region 106 of full length composite plate 104 may include heel cup 107. Here, the arch region and the forefoot region are shown in phantom. Heel cup 107 includes heel outer periphery 150 and central portion 118. In a preferred embodiment, heel outer periphery 150 is disposed at an angle to central portion 118. Heel outer periphery 150 includes medial portion 1112, lateral portion 1116, and rear portion 1114.

As heel cup 107 is associated with the heel of the foot, the various portions of the heel cup are intended to provide support for the heel. In particular, central portion 118 is disposed under the heel during use. Likewise, medial portion 1112 may be disposed against the medial side of the heel during use. Lateral portion 1116 may be disposed against the medial side of the heel during use. Rear portion 1114 may be disposed against the rear of the heel during use.

During use of the article of footwear, there may be a tendency for the heel to move outside of the heel region of the outsole. Medial portion 1112, lateral portion 1116, and rear portion 1114 each act to keep the heel confined to the heel region of the outsole.

In some embodiments, heel cup 107 may be used simultaneously with a minimal heel counter. This minimal heel counter may be either internal or external. In some embodiments, heel cup 107 may be used instead of a heel counter.

Although in this embodiment, tread elements are directly attached to full length composite plate 104, other embodiments may include tread elements that have been over-molded on a full length composite plate, as part of an outsole assembly. The over-molded material may include tread elements, as well as other structural elements for the outsole assembly. Embedding the full length composite plate in the molded material may be accomplished by using an over-molding technique.

Figure 19:
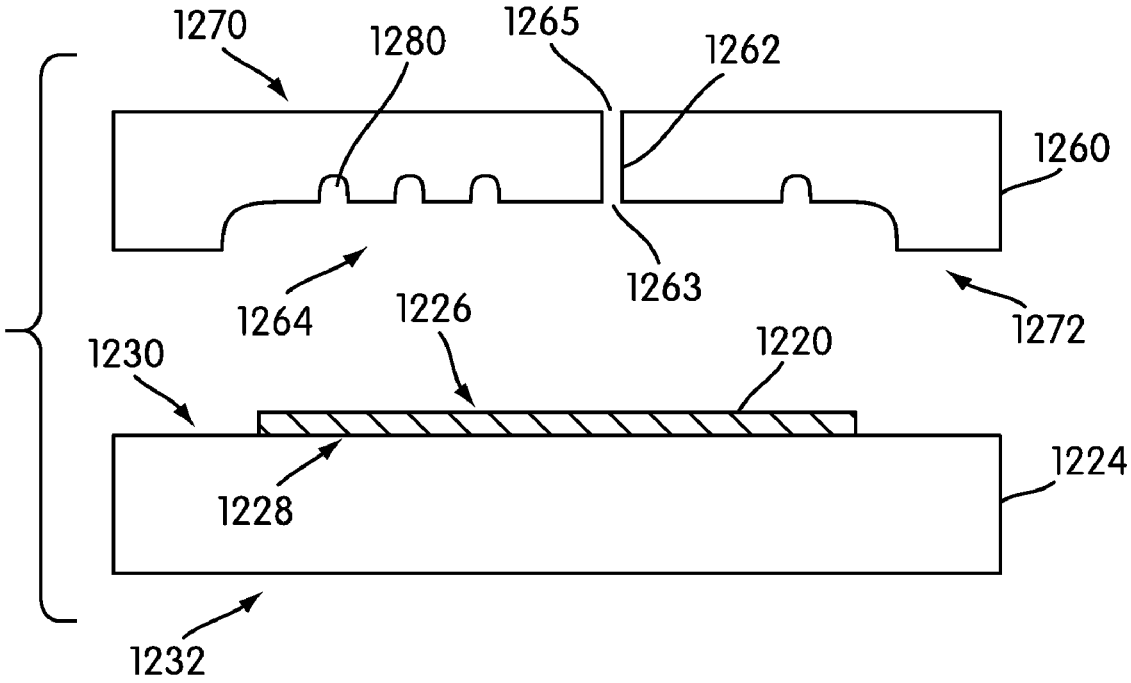
FIG. 19 is a schematic view of a preferred embodiment of a first step of a method for making an outsole assembly.

In FIG. 19, a schematic diagram of a preferred embodiment of a first step of a method for making an outsole assembly is shown. The method of making an outsole assembly includes a full length composite plate 1220, a molding base 1224, and a mold 1260. Molding base 1224 provides support for full length composite plate 1220 during the over-molding process. Mold 1260 is used to create the over-mold to be attached directly to full length composite plate 1220, which may include tread elements as well as other structural features. In some embodiments, full length composite plate 1220 can also create support and shutoff in regions where over-molding is not desired.

Full length composite plate 1220 includes a first side 1226 and a second side 1228. Molding base 1224 includes a first side 1230 and a second side 1232. Mold 1260 includes a first side 1270 and a second side 1272. Mold 1260 also includes molding channel 1262 and central cavity 1264. Central cavity 1264 is manufactured to yield the desired molded portion for full length composite plate 1220, once a molding material has been added. Molding channel 1262 provides a means for filling central cavity 1264 with a molding material. Molding channel 1262 is preferably in fluid communication with central cavity 1264 through first orifice 1263. Second orifice 1265 is preferably disposed along first mold side 1270.

Although in this embodiment only one molding channel is shown, other embodiments may include multiple molding channels. These molding channels may be used in a similar way to that of molding channel 1262, providing a means for filling central cavity 1264 with a molding material.

Central cavity 1264, when filled with a molding material, yields the molded portion of an outsole assembly. In some embodiments, central cavity 1264 includes at least one secondary cavity 1280. This secondary cavity is disposed along the periphery of central cavity 1264. The secondary cavity may be shaped like a tread element in some embodiments. Multiple secondary cavities may also be included in central cavity 1264. Thus, by using central cavity 1264 and secondary cavities, the molded portion of the outsole assembly may include traction elements and other general structure for the molded portion of the outsole assembly.

During the first step in the method of making an outsole assembly, second side 1228 of full length composite plate 1220 is associated with first side 1230 of molding base 1224. Full length composite plate 1220 is preferably fixed to molding base 1224 via clamp pressure and part geometry reflected in the mold cavity and core.

Figure 20:
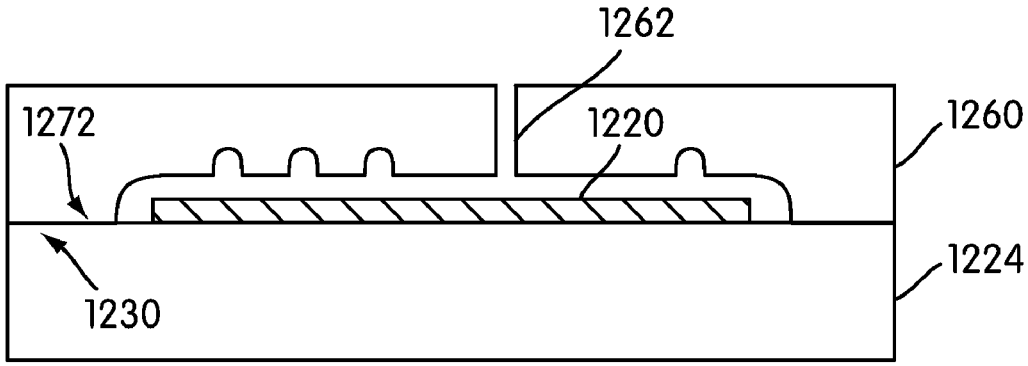
FIG. 20 is a schematic view of a preferred embodiment of a second step of a method for making an outsole assembly.

FIG. 20 is a schematic diagram of a preferred embodiment of a second step of the method for making an outsole assembly. During this second step, second side 1272 of mold 1260 is associated with first side 1230 of molding base 1224. This step may be accomplished by lowering mold 1260 onto molding base 1224, forming central cavity 1264. In the embodiment shown in FIG. 20, the perimeter of central cavity rim 1302, disposed along second surface 1272 of central cavity 1264 is preferably larger than the perimeter of both the first side 1226 and the second side 1228 of full length composite plate 1220.

Figure 21:
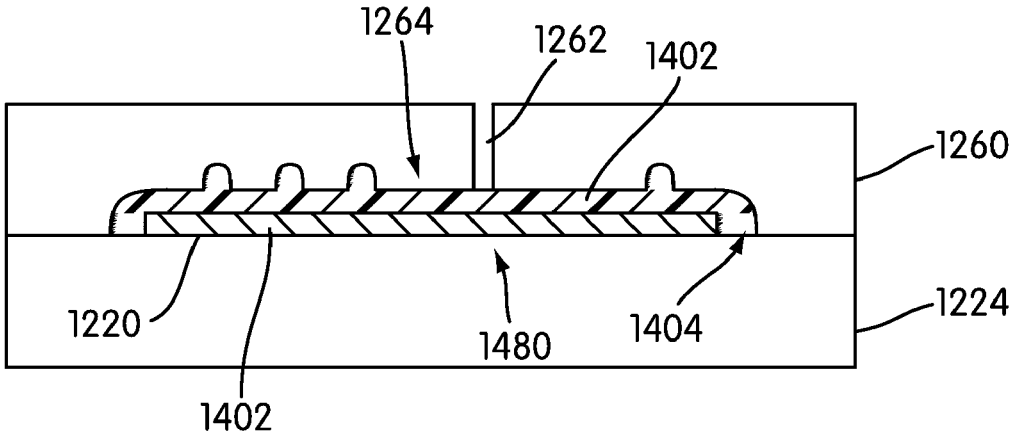
FIG. 21 is a schematic view of a preferred embodiment of a third step of a method for making an outsole assembly.

FIG. 21 is a schematic diagram of a preferred embodiment of a third step of the method for making an outsole assembly. During this third step, a molding material 1402, which is preferably in liquid or viscous form during this step, is injected into central cavity 1264 via mold channel 1262. Molding material 1402 preferably fills the entire cavity. During this third step, full length composite plate 1220 is embedded in molding material 1402. In particular, the first side 1404 of molding material 1402 is disposed against first side 1230 of molding base 1224. First side 1404 of molding material 1402 is disposed flush with second side 1228 of full length composite plate 1220. In some areas, for example, the lateral and/or medial edges of the arch region 1480, molding material 1402 may sandwich full length composite plate 1220.

Figure 22:
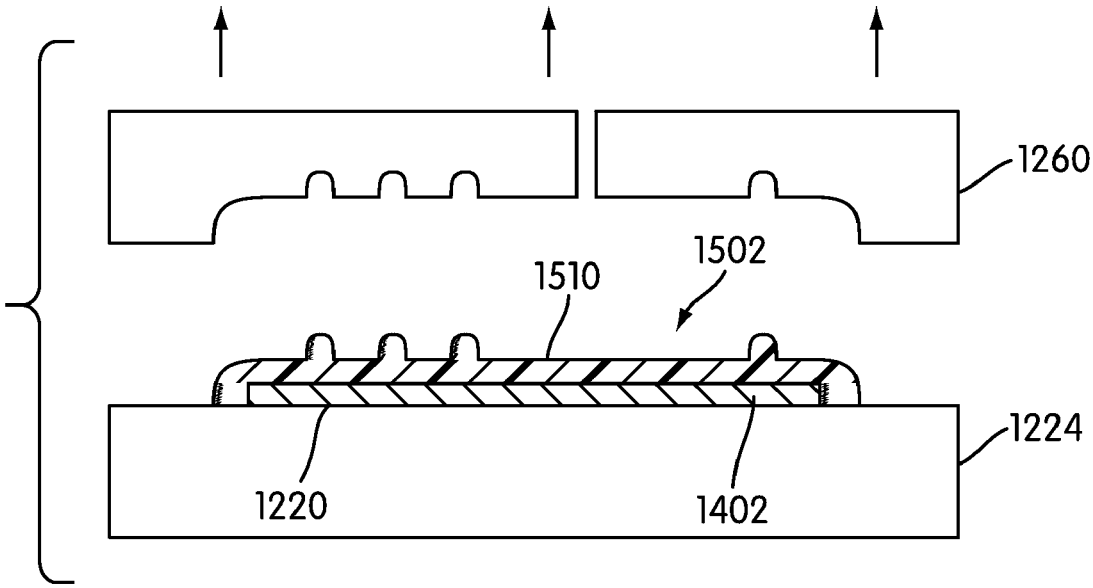
FIG. 22 is a schematic view of a preferred embodiment of an outsole assembly.

FIG. 22 is a schematic diagram of a preferred embodiment of a fourth and final step of the method for making an outsole assembly. During this fourth step, mold 1260 is removed from molding base 1224, after molding material 1402 has solidified. This step may be accomplished by raising mold 1260 with respect to molding base 1224. What remains is outsole assembly 1502, which includes full length composite plate 1220 and molding 1510. Outsole assembly 1502 may also be removed from molding base 1224 during this step.

In some cases, full length composite plate 1220 may be sandwiched by molding 1510. In some embodiments, the entire full length composite plate 1220 is sandwiched by molding 1510. In some embodiments, only portions of full length composite plate 1220 may be sandwiched by molding 1510.

Figure 23:
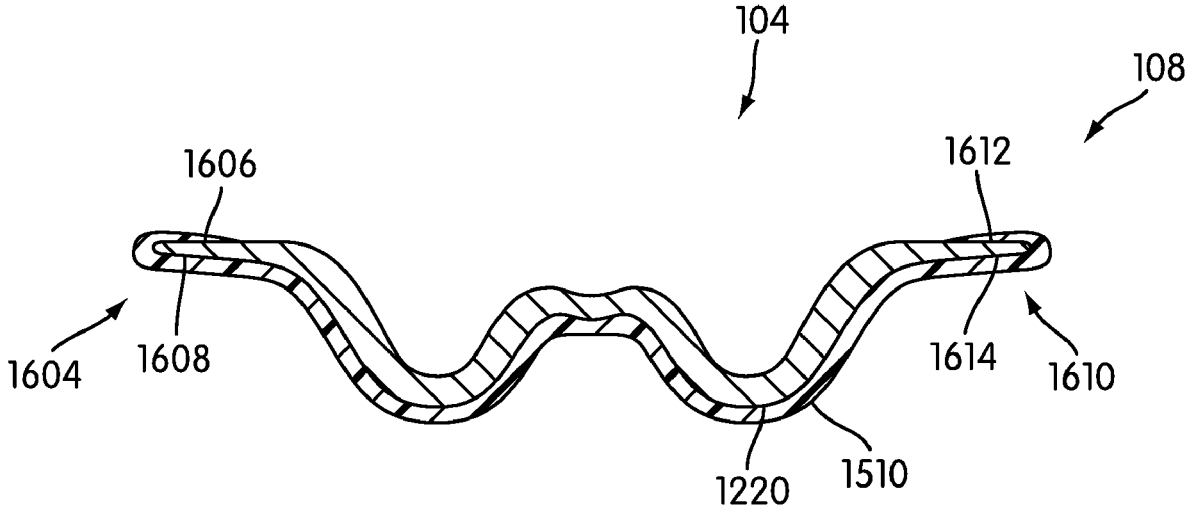
FIG. 23 is a cross sectional view of a preferred embodiment of an edge of a full length composite plate.

In particular, first edge 1604 of full length composite plate 1220 is preferably covered by molding 1510. As seen in FIG. 23, upper surface 1606 of first edge 1604 and lower surface 1608 of first edge 1604 are preferably both in contact with molding 1510. This arrangement provides a sandwiched structure where molding 1510 encases first edge 1604.

In a similar manner, second edge 1610 of full length composite plate 1220 is also preferably covered by molding 1510. As shown in FIG. 23, upper surface 1612 and lower surface 1614 of second edge 1610 are preferably both in contact with molding 1510. This arrangement provides a sandwiched structure where molding 1510 encases second edge 1610.

This arrangement allows first edge 1604 and second edge 1610 of full length composite plate 1220 to be better protected. It may also increase the area of contact between molding 1510 and full length composite plate 1220. Generally, the transition between molding material 1510 and full length composite plate 1220 is smooth along first edge 1604 and second edge 1610. In some embodiments, tread elements may extend from molding 1510, projecting in a direction opposite of full length composite plate 1220.

FIGS. 19-22 are schematic illustrations of the process by which an over-molding is applied to full length composite plate 1220. In a preferred embodiment, mold 1260 and molding base 1224 would also preferably include provisions for receiving and molding around all the physical features previously discussed as part of a preferred embodiment of full length composite plate 1220. For example, in a preferred embodiment, mold 1260 and molding base 1224 would each be configured with portions configured to be disposed adjacent to a first angled portion and a second angled portion of full length composite plate 1220. That is, the first side 1230 (see FIG. 20) of molding base 1224 need not be flat, but may include curves corresponding to unique features of a full length composite plate. In a similar manner, second side 1272 of mold 1230 may include curves corresponding to unique features of a full length composite plate.

In a preferred embodiment, a full length composite plate may be designed to provide maximum flexibility along the forefoot. In the human foot there is a natural bend line that occurs at a diagonal across the forward region of the foot. In order to provide maximum flexibility, it is desired that components of an article of footwear are designed to bend elastically in this region.

Figure 24:
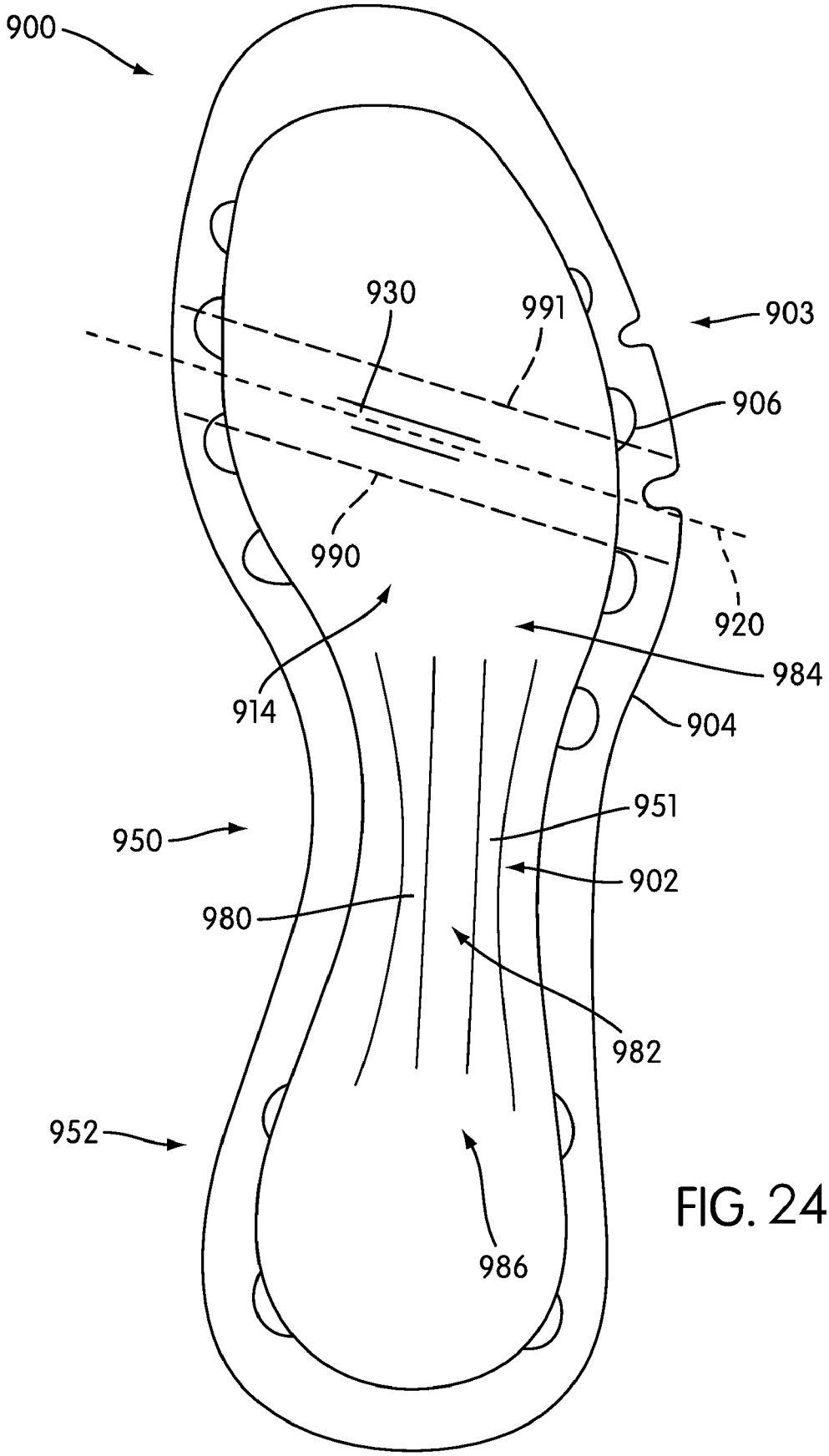
FIG. 24 is a plan view of an alternative embodiment of an outsole assembly with a bending region.

FIG. 24 shows an alternative embodiment of outsole assembly 900 that includes full length composite plate 902 and molding 904. Outsole assembly 900 includes forefoot region 903, arch region 950 and heel region 952.

Preferably, outsole assembly 900 includes provisions that facilitate bending along forefoot region 903. In FIG. 24, 920 represents the natural bend line of the foot. Bending region 991 is a region proximate to natural bend line 920. Some embodiments include provisions to increase the flexibility of bending region 991. In some embodiments, molding slot 930 is provided to allow increased flexibility in bending region 991.

In some embodiments, flexibility is increased in bending region 991 of molding 904 by reducing the thickness of molding 904 along molding slot 930. Additionally, forefoot region 903 is relatively flat when compared with arch region 950 and heel region 952. These features allow forefoot region 903 to have increased flexibility in comparison to arch region 950 and heel region 952. In particular, a bending region 990 of forefoot region 903 has increased flexibility over arch region 950 and heel region 952. In some embodiments, bending region 990 may be a region other than forefoot region 903. In some embodiments, bending region 990 may be an arch region or a heel region.

Additionally, full length composite plate 902 may include first angled portion 980 and second angled portion 982. First angled portion 980 and second angled portion 982 are preferably wider at first end 984 and second end 986 of arch region 950. In a preferred embodiment, first angled portion 980 and second angled portion 982 are more narrow along middle portion 951 of arch region 950. As previously discussed, first angled portion 980 and second angled portion 982 add support to arch region 950.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear comprising:

an upper forming a footwear collar therein;

an insert;

a heel member attached to the insert forming an insert system;

a first attachment region formed on an upper medial portion of the heel member;

a second attachment region formed on an upper rear portion of the heel member;

a third attachment region formed on an upper lateral portion of the heel member;

a first part of a first releasable fastener disposed at the first attachment region of the heel member configured to attach to a second part of the first releasable fastener fixed to an inside medial surface of the footwear collar;

a first part of a second releasable fastener disposed at the second attachment region of the heel member configured to attach to a second part of the second releasable fastener fixed to an inside rear surface of the footwear collar;

a first part of a third releasable fastener disposed at the third attachment region of the heel member configured to attach to a second part of the third releasable fastener fixed to an inside lateral surface of the footwear;

an outsole assembly;

the outsole assembly including a full length composite plate;

the full length composite plate comprising a first plurality of layers alternating with a second plurality of layers;

each layer of the first plurality of layers comprising a full length non-woven sheet;

each layer of the second plurality of layers comprising a full length woven fiber sheet;

the full length composite plate further comprising a first tie layer disposed on a first side of the alternating first and second pluralities of layers and a second tie layer disposed on a second side of the alternating first and second pluralities of layers opposite to the first side, and wherein the first tie layer and the second tie layer each has a thickness greater than a thickness of each individual layer of the alternating first and second pluralities of layers;

the full length composite plate including an outer layer, wherein the outer layer comprises a layer of one of the first tie layer and the second tie layer;

the outsole assembly also including tread elements; and wherein the tread elements are secured directly to the outer layer of the full length composite plate.

2. The article of footwear according to claim 1, wherein the first, second and third releasable fasteners each include a mechanical fastener.

3. The article of footwear according to claim 1, wherein the heel member includes a hole.

4. The article of footwear according to claim 3, wherein the hole of the heel member is configured to receive a protruding region disposed on the insert.

5. The article of footwear according to claim 4, wherein the protruding region is generally circular and the hole is generally round.

6. The article of footwear according to claim 4, wherein the protruding region is larger than the hole thereby creating an interference fit.

7. The article of footwear according to claim 1, wherein an outer surface of the insert system is smooth.

8. An article of footwear comprising:

an upper;

an insert comprising a heel member configured to be removably insertable into a heel section of the upper of the article of footwear an insole portion attachable to the heel member and extending from the heel member towards a toe section of the upper of the article of footwear;

a first attachment region formed on an upper medial portion of the heel member;

a second attachment region formed on an upper rear portion of the heel member;

a third attachment region formed on an upper lateral portion of the heel member;

a first part of a first releasable fastener disposed at the first attachment region of the heel member configured to attach to a second part of the first releasable fastener fixed to an inside medial surface of a footwear collar of the upper, wherein the first attachment region defines a first recess within which the first part of the first releasable fastener is disposed such that an outer surface of the first part of the first releasable fastener is flush with an outer surface of the first attachment region of the upper medial portion of the heel member;

a first part of a second releasable fastener disposed at the second attachment region of the heel member configured to attach to a second part of the second releasable fastener fixed to an inside rear surface of the footwear collar, wherein the second attachment region defines a second recess within which the first part of the second releasable fastener is disposed such that an outer surface of the first part of the second releasable fastener is flush with an outer surface of the second attachment region of the upper rear portion of the heel member; and a first part of a third releasable fastener disposed at the third attachment region of the heel member configured to attached to a second part of the third releasable fastener fixed to an inside lateral surface of the footwear collar, wherein the third attachment region defines a third recess within which the first part of the third releasable fastener is disposed such that an outer surface of the first part of the third releasable fastener is flush with an outer surface of the third attachment region of the upper lateral portion of the heel member; and an outsole assembly, the outsole assembly including a full length composite plate, the full length composite plate comprising a first plurality of layers alternating with a second plurality of layers, each layer of the first plurality of layers comprising a full length non-woven sheet, each layer of the second plurality of layers comprising a full length woven fiber sheet, the full length composite plate further comprising a first tie layer disposed on a first side of the alternating first and second pluralities of layers and a second tie layer disposed on a second side of the alternating first and second pluralities of layers opposite to the first side, and wherein the first tie layer and the second tie layer each has a thickness greater than a thickness of each individual layer of the alternating first and second pluralities of layers, the full length composite plate including an outer layer, wherein the outer layer comprises a layer of one of the first tie layer and the second tie layer, the outsole assembly also including tread elements, and wherein the tread elements are secured directly to the outer layer of the full length composite plate.

9. The insert of claim 8, wherein the heel member is attached to the heel section of the upper.

10. The insert of claim 9, wherein the first, second and third releasable fasteners each include hook-and-loop releasable fasteners for attaching the heel member to the heel section of the upper.

11. An article of footwear comprising:

an upper;

an insert comprising a heel member configured to be removably insertable into a heel section of the upper of the article of footwear; and an insole portion attachable to the heel member and extending from the heel member towards a toe section of the upper of the article of footwear;

wherein the heel member is attached to the heel section of the upper with a hook-and-loop connector, and wherein a section of the hook-and-loop connector is disposed within a recess in an outer surface of the heel member such that an outer surface of the section is flush with the outer surface of the heel member, and wherein a corresponding section of the hook-and-loop connector is disposed within a recess in an outer surface of an inside portion of the upper such that an outer surface of the corresponding section is flush with the outer surface of the inside portion of the upper; and an outsole assembly, the outsole assembly including a full length composite plate, the full length composite plate comprising a first plurality of layers alternating with a second plurality of layers, each layer of the first plurality of layers comprising a full length non-woven sheet, each layer of the second plurality of layers comprising a full length woven fiber sheet, the full length composite plate further comprising a first tie layer disposed on a first side of the alternating first and second pluralities of layers and a second tie layer disposed on a second side of the alternating first and second pluralities of layers opposite to the first side, and wherein the first tie layer and the second tie layer each has a thickness greater than a thickness of each individual layer of the alternating first and second pluralities of layers, the full length composite plate including an outer layer, wherein the outer layer comprises a layer of one of the first tie layer and the second tie layer, the outsole assembly also including tread elements, and wherein the tread elements are secured directly to the outer layer of the full length composite plate.

12. The insert of claim 8, wherein the insole portion is interference fitted to the heel member.

13. The insert of claim 8, wherein the insole portion is substantially flush to a sole portion of the article of footwear when inserted into the article of footwear.

14. The insert of claim 8, wherein the insert customizes a fit of the article of footwear.

15. The insert of claim 8, wherein the insert customizes performance of the article of footwear.

16. A method of assembling an article of footwear comprising:

selecting a heel member from a plurality of candidate heel members, wherein an upper medial portion of the heel member defines a first recess within which a first part of a first hook-and-loop connector is disposed such that an outer surface of the upper medial portion is flush with an outer surface of the first part of the first hook-and-loop connector, wherein an upper rear portion of the heel member defines a second recess within which a first part of a second hook-and-loop connector is disposed such that an outer surface of the upper rear portion is flush with an outer surface of the first part of the second hook-and-loop connector, wherein an upper lateral portion of the heel member defines a third recess within which a first part of a third hook-and-loop connector is disposed such that an outer surface of the upper lateral portion is flush with an outer surface of the first part of the third hook-and-loop connector;

selecting an insert from a plurality of candidate insert members;

attaching the selected heel member with the selected insert forming an insert system;

placing the insert system inside the article of footwear, wherein a medial region of an upper of the article of footwear defines a fourth recess within which a second part of the first hook-and-loop connector is disposed such that an outer surface of medial region is flush with an outer surface of the second part of the first hook-and-loop connector, wherein a rear region of the upper of the article of footwear defines a fifth recess within which a second part of the second hook-and-loop connector is disposed such that an outer surface of rear region is flush with an outer surface of the second part of the second hook-and-loop connector, wherein a lateral region of the upper of the article of footwear defines a sixth recess within which a second part of the third hook-and-loop connector is disposed such that an outer surface of lateral region is flush with an outer surface of the second part of the third hook-and-loop connector, wherein the article of footwear comprises the upper, and an outsole assembly, the outsole assembly including a full length composite plate;

the full length composite plate comprising a first plurality of layers alternating with a second plurality of layers, each layer of the first plurality of layers comprising a full length non-woven sheet, each layer of the second plurality of layers comprising a full length woven fiber sheet, the full length composite plate further comprising a first tie layer disposed on a first side of the alternating first and second pluralities of layers and a second tie layer disposed on a second side of the alternating first and second pluralities of layers opposite to the first side, and wherein the first tie layer and the second tie layer each has a thickness greater than a thickness of each individual layer of the alternating first and second pluralities of layers, the full length composite plate including an outer layer, wherein the outer layer comprises a layer of one of the first tie layer and the second tie layer, the outsole assembly also including tread elements, and wherein the tread elements are secured directly to the outer layer of the full length composite plate;

attaching the upper medial portion of the heel member to the medial region of the upper of the article of footwear by contacting the outer surface of the medial region of the upper to the outer surface of the upper medial portion of the heel member along a first contact boundary when viewed in cross-section and attaching the first part of the first hook-and-loop connector to the second part of the first hook-and-loop connector across the first contact boundary;

attaching the upper rear portion of the heel member to the rear region of the upper by contacting the outer surface of the rear region of the upper to the outer surface of the upper rear portion of the heel member along a second contact boundary when viewed in cross-section and attaching the first part of the second hook-and-loop connector to the second part of the second hook-and-loop connector across the second contact boundary; and attaching the upper lateral portion of the heel member to the lateral region of the upper by contacting the outer surface of the lateral region of the upper to the outer surface of the upper lateral portion of the heel member along a third contact boundary when viewed in cross-section and attaching the first part of the third hook-and-loop connector to the second part of the third hook-and-loop connector across the third contact boundary.

17. The method according to claim 16, wherein attaching the upper medial portion of the heel member to the medial region of the upper includes attaching the first part of the first hook-and-loop connector to the second part of the first hook-and-loop connector in between the upper medial portion of the heel member and the medial region of the upper, wherein attaching the upper rear portion of the heel member to the rear region of the upper includes attaching the first part of the second hook-and-loop connector to the second part of the second hook-and-loop connector in between the upper rear portion of the heel member and the rear region of the upper, and attaching the upper lateral portion of the heel member to the lateral region of the upper includes attaching the first part of the third hook-and-loop connector to the second part of the third hook-and-loop connector in between the upper lateral portion of the heel member and the lateral region of the upper.

18. The method according to claim 16, wherein attaching the selected heel member with the selected insert includes placing a protruding region associated with the insert into a hole associated with the heel member.

19. The method according to claim 16, wherein attaching the selected heel member with the selected insert includes attaching the heel member to the article of footwear through a releasable fastener system.

20. The insert of claim 8, wherein the outer surface of the second attachment region of the upper medial portion is configured to contact a surface of the heel section of the upper of the article of footwear along a contact boundary when viewed in cross-section, and wherein the first part of the second releasable fastener is configured to attach to a second part of the second releasable fastener across the contact boundary.

21. The insert of claim 8, wherein the first parts of the first, second and third releasable fasteners each include portions of hook-and-loop releasable fasteners.

* * * * *